US007785760B2

(12) United States Patent
Yamamoto et al.

(10) Patent No.: US 7,785,760 B2
(45) **Date of Patent: *Aug. 31, 2010**

(54) TONER AND METHOD OF PREPARING THE TONER

(75) Inventors: Atsushi Yamamoto, Kawanishi (JP); Chiyoshi Nozaki, Ohtsu (JP); Tsuyoshi Nozaki, Ikeda (JP); Minoru Nakamura, Takarazuka (JP); Yoshimichi Ishikawa, Itami (JP)

(73) Assignee: Ricoh Company Limited, Tokyo (JP)

( * ) Notice: Subject to any disclaimer, the term of this patent is extended or adjusted under 35 U.S.C. 154(b) by 521 days.

This patent is subject to a terminal disclaimer.

(21) Appl. No.: 11/624,453

(22) Filed: Jan. 18, 2007

(65) Prior Publication Data

US 2007/0166635 A1 Jul. 19, 2007

(30) Foreign Application Priority Data

Jan. 18, 2006 (JP) ..... 2006-009404
Feb. 2, 2006 (JP) ..... 2006-025871

(51) Int. Cl.
*G03G 9/08* (2006.01)

(52) U.S. Cl. ..... 430/108.8; 430/110.1; 430/110.3; 430/109.4; 430/137.15

(58) Field of Classification Search ..... 430/108.8, 430/110.1, 110.3, 109.3, 109.4, 137.15
See application file for complete search history.

(56) References Cited

U.S. PATENT DOCUMENTS 5,413,890 A * 5/1995 Mori et al. ..... 430/110.1
5,659,857 A 8/1997 Yamazaki et al.
5,853,939 A 12/1998 Yanagibori et al.
6,096,468 A 8/2000 Ohno et al.
6,177,223 B1 * 1/2001 Hashimoto et al. ..... 430/110.1
7,056,638 B1 * 6/2006 Tomita et al. ..... 430/108.8
7,157,199 B2 * 1/2007 Emoto et al. ..... 430/108.22

(Continued)

FOREIGN PATENT DOCUMENTS

JP 63-104064 5/1988

(Continued)

OTHER PUBLICATIONS

U.S. Appl. No. 11/924,994, filed Oct. 26, 2007, Katoh et al.

(Continued)

*Primary Examiner*—John L Goodrow
(74) *Attorney, Agent, or Firm*—Oblon, Spivak, McClelland, Maier & Neustadt, L.L.P.

(57) ABSTRACT

A toner is provided including a binder resin, a colorant, and a release agent, which has a volume average particle diameter (Dv) of from 3 to 9 μm, and wherein the binder resin and the release agent form a sea-island structure in which the island formed of the release agent is dispersed in the sea formed of the binder resin in a cross-sectional image of the toner obtained by a transmission electron microscope (TEM), and the following relationships are satisfied: IB>IA and IB>IC, wherein each of IA, IB, and IC represents an area ratio (%) of the island in an outermost region (A) of the cross-sectional image of the toner, an intermediate region (B) thereof located under the outermost region (A), and an innermost region (C) thereof located under the intermediate region (B); and a method of preparing the toner.

22 Claims, 2 Drawing Sheets

U.S. PATENT DOCUMENTS

| | | | | |
|---|---|---|---|---|
| 7,169,527 | B2 * | 1/2007 | Ito et al. | 430/110.2 |
| 2002/0172879 | A1 | 11/2002 | Kada et al. | |
| 2004/0126147 | A1 | 7/2004 | Kondo et al. | |
| 2005/0074685 | A1 * | 4/2005 | Kido et al. | 430/110.2 |
| 2005/0100809 | A1 * | 5/2005 | Fujino et al. | 430/110.2 |
| 2006/0204882 | A1 | 9/2006 | Nozaki et al. | |
| 2006/0204883 | A1 | 9/2006 | Nakayama et al. | |
| 2006/0210902 | A1 | 9/2006 | Nakamura et al. | |
| 2006/0275686 | A1 | 12/2006 | Kadota et al. | |
| 2008/0268366 | A1 | 10/2008 | Nakayama et al. | |

FOREIGN PATENT DOCUMENTS

| | | |
|---|---|---|
| JP | 4-337737 | 11/1992 |
| JP | 5-119513 | 5/1993 |
| JP | 5-341573 | 12/1993 |
| JP | 6-208244 | 7/1994 |
| JP | 6-230600 | 8/1994 |
| JP | 6-295093 | 10/1994 |
| JP | 6-324514 | 11/1994 |
| JP | 7-84401 | 3/1995 |
| JP | 7-209952 | 8/1995 |
| JP | 7-120076 | 12/1995 |
| JP | 9-96920 | 4/1997 |
| JP | 9-127720 | 5/1997 |
| JP | 9-258471 | 10/1997 |
| JP | 2886998 | 2/1999 |
| JP | 2909698 | 4/1999 |
| JP | 2962907 | 8/1999 |
| JP | 11-258934 | 9/1999 |
| JP | 11-258935 | 9/1999 |
| JP | 11-327199 | 11/1999 |
| JP | 2001-013732 | 1/2001 |
| JP | 3219316 | 8/2001 |
| JP | 2001-305782 | 11/2001 |
| JP | 2002-6541 | 1/2002 |
| JP | 2002-91060 | 3/2002 |
| JP | 3284802 | 3/2002 |
| JP | 2002-116574 | 4/2002 |
| JP | 3314326 | 6/2002 |
| JP | 2002-212142 | 7/2002 |
| JP | 3359654 | 10/2002 |
| JP | 2003-076056 | 3/2003 |
| JP | 3458629 | 8/2003 |
| JP | 2004-133440 | 4/2004 |
| JP | 2004-145243 | 5/2004 |
| JP | 2004-271859 | 9/2004 |
| JP | 2004-318043 | 11/2004 |
| JP | 2005-196056 | 7/2005 |
| WO | WO 97/01131 | 1/1997 |

OTHER PUBLICATIONS

U.S. Appl. No. 11/857,175, filed Sep. 18, 2007, Matsumoto et al.
U.S. Appl. No. 12/017,853, filed Jan. 22, 2008, Masumoto et al.
U.S. Appl. No. 12/026,057, filed Feb. 5, 2008, Nozaki et al.
U.S. Appl. No. 12/046,784, filed Mar. 12, 2008, Nozaki et al.
U.S. Appl. No. 12/046,866, filed Mar. 12, 2008, Matsumoto et al.
U.S. Appl. No. 12/048,689, filed Mar. 14, 2008, Kadota et al.
U.S. Appl. No. 12/049,719, filed Mar. 17, 2008, Yamamoto et al.
U.S. Appl. No. 12/050,663, filed Mar. 18, 2008, Izutani et al.
U.S. Appl. No. 12/050,963, filed Mar. 19, 2008, Ishikawa et al.
U.S. Appl. No. 12/043,633, filed Mar. 6, 2008, Nakamura et al.
U.S. Appl. No. 12/046,869, filed Mar. 12, 2008, Nozaki et al.
U.S. Appl. No. 12/172,378, filed Jul. 14, 2008, Yamamoto et al.
U.S. Appl. No. 11/851,617, filed Sep. 7, 2007, Murakami et al.
U.S. Appl. No. 11/854,783, filed Sep. 13, 2007, Nakamura et al.
Japanese Office Action issued on Jun. 15, 2010.

* cited by examiner

TONER AND METHOD OF PREPARING THE TONER

BACKGROUND OF THE INVENTION

1. Field of the Invention

The present invention relates to a toner for use in electrophotography. In addition, the present invention also relates to a method of preparing the toner.

2. Discussion of the Background

In electrophotography, electrostatic recording, electrostatic printing, etc., a developer firstly adheres to an electrostatic latent image formed on an image bearing member (such as a photoreceptor) in a developing process. Secondly, the developer is transferred from the image bearing member onto a transfer medium (such as a transfer paper) in a transfer process. Finally, the developer is fixed on the transfer medium in a fixing process. As a developer, a two-component developer consisting of a carrier and a toner, and a one-component developer consisting essentially of a toner (e.g., a magnetic toner, a non-magnetic toner) are known.

Conventionally, a pulverized toner, in which a toner binder (such as a styrene resin and a polyester resin) and toner components (such as a colorant) are melt-kneaded and pulverized, is used for electrophotography, electrostatic recording, electrostatic printing, etc.

(Problems in Chargeability)

In the two-component developer, a toner is friction-charged by contacting a carrier. In the one-component developer, a toner is friction-charged by contacting a supplying roller which supplies the toner to a developing sleeve or a toner layer thickness controlling blade which makes a toner layer formed on the developing sleeve uniform. In order to faithfully reproduce an electrostatic latent image formed on a photoreceptor, the toner is required to have good chargeability. Various attempts to use charge controlling agents and to combine them to a toner have been made to improve the chargeability.

Charge controlling agents are very expensive in many cases. Since the charge controlling agent functions at the surface of a toner, attempts to arrange a small amount of a charge controlling agent on the surface of a toner have been made. Published unexamined Japanese Patent Applications Nos. (hereinafter referred to as JP-A) 63-104064, 05-119513, 09-127720, and 11-327199 have disclosed toners, on the surface of which a charge controlling agent is adhered, to improve chargeability thereof. However, the charge controlling agent easily released from the toner in the above cases, and therefore chargeability of the resultant toner deteriorates. The methods of adhering the charge controlling agent are also insufficient to impart good chargeability (such as initial charging rate) to the resultant toner.

JP-A 63-244056 discloses a method of preparing a toner in which a charge controlling agent is adhered and fixed onto the surface of the toner upon application of an impulse force generated from a gap formed between a rotor (i.e., a blade rotating at a high speed) and projections fixed on an inner wall of a stator (i.e., a casing). The inner wall is not smooth because the projections are formed thereon, and therefore a high-speed airflow tends to be turbulent. As a result, toner particles tends to be excessively pulverized, a part of the surfaces of toner particles tend to melt, and the charge controlling agent tends to be buried in the surface of toner particles, resulting in uneven treatment of the surface of toner particles. It is considered that the above phenomena are caused by the differences in the energy levels among individual toner particles.

(Problems in Fixability)

When a toner is fixed, contact heat fixing methods such as a heat roller fixing method and a belt fixing method (disclosed in JP 3195362 and JP-A 2002-116574, for example) are typically used.

In contact heat fixing methods, a toner image formed on a transfer paper sheet is contacted with the surface of a heat member of a contact heat fixing device. Therefore, the contact heat fixing methods tend to cause an offset problem in that part of a fused toner image is adhered and transferred to the surface of the heat member, and then the part of the toner image is re-transferred to an undesired portion of the sheet itself or the following sheet of the transfer paper.

In addition, the contact heat fixing methods tend to cause a paper winding problem such that a transfer paper sheet having a melted toner image thereon is wound around fixing members (such as a heat roller and a fixing belt) contacting the toner image due to adhesion of the toner image to the fixing members.

When the temperature of the heat member is too low, the toner cannot sufficiently melt and cannot be well fixed on the paper. In terms of energy saving and downsizing of apparatuses, a need exists for a toner which minimizes hot offset (this property is hereinafter referred to as hot offset resistance) and which can be fixed at low temperatures (this property is hereinafter referred to as low-temperature fixability). The toner is also required to have a property such that the toner does not cause a blocking problem even when the toner is stored at the temperature inside an apparatus (this property is hereinafter referred to as thermostable preservability). In particular, full-color copiers and printers are required to produce images having glossiness and color-mixing property, and therefore polyester resins are widely used as a full-color toner binder because of having low-melt viscosity. Since such a toner easily causes hot offset, a silicone oil is typically applied to a heat member in the full-color copiers and printers. In this case, the apparatus needs an oil tank and an oil applicator, and therefore the apparatus must be larger and complicated. In addition, the heat member is easily damaged, and therefore maintenance has to be constantly performed. There is another problem such that the oil applied to the heat member tends to adhere to copier papers and overhead projection (OHP) films, resulting in deterioration of the color tone of the produced images.

In attempting to solve these problems, a technique in which a wax is added to a toner is proposed and widely used to prevent the toner from adhering to the heat roller without applying an oil thereto. Releasability of the toner greatly depends upon dispersing conditions of the wax in the toner. When the wax is compatible with the binder resin used, the toner has no releasability. When the wax is incompatible with the binder resin and forms domains thereof in the toner, the toner has releasability. In this case, the wax domains tend to expose at the surface of the toner in the manufacturing process. Thereby, fluidity of the toner deteriorates, resulting in deterioration of transferability thereof. In addition, the wax tends to contaminate image forming members such as a photoreceptor, a carrier, a developing roller, and a controlling member. In a pulverized toner, the wax tends to exist at pulverized sections, i.e., the wax tends to exist at the surface of the toner particles.

(Problems in Particle Diameter and Shape)

In order to produce high definition and high quality images, toners are improved to have a smaller particle diameter and a narrower particle diameter distribution. Since conventional pulverized toner particles have irregular shapes, the toner particles tend to be excessively pulverized when mixed with a carrier in a developing device (when used for a two-component developer), or when contacting a developing roller, a toner supplying roller, a toner layer thickness controlling blade, a friction-charging blade, etc. under stress (when used for a one-component developer). As a result, the resultant image quality deteriorates because ultra-fine particles are produced and a fluidizer is buried in the surfaces of the toner particles. Since such an irregular-shaped toner has poor fluidity, there is a problem that the toner needs a large amount of a fluidizer. Another problem is that a toner bottle must be larger because such an irregular-shaped toner cannot effectively fill up the toner bottle, resulting in disturbing downsizing of the apparatus.

A full-color transfer process in which a full-color toner image is transferred from a photoreceptor to a transfer medium or a paper is complicated. On the other hand, a pulverized toner has poor transferability due to its shape. When the pulverized toner is used for the full-color transfer process, the transferred image may have image defects and a large amount of the toner is consumed so as to compensate the image defects.

Therefore, there are demands for improving transferability of the toner to produce high quality images by reducing image defect and to reduce the running cost by reducing the amount of the toner consumed. If the toner has good transferability, the toner particles tend not to remain on the photoreceptor or the transfer medium, and therefore the apparatus does not need a cleaning unit. As a result, the apparatus can be downsized and the cost thereof can be reduced. In addition, waste toner particles are not produced. In attempting to overcome the above drawbacks of the irregular-shaped toner, various methods of preparing a spherical toner are proposed.

For example, in attempting to improve both low-temperature fixability and hot offset resistance of a toner, a technique in which a release agent (e.g., a polyolefin wax) having a low melting point is added to a toner is proposed.

JP-As 06-295093, 07-84401, and 09-258471 have disclosed toners including a wax having a specific endothermic peak measured by a differential scanning calorimeter (DSC). However, these toners do not sufficiently satisfy low-temperature fixability, hot offset resistance, and developability.

JP-As 05-341577, 06-123999, 06-230600, 06-295093, and 06-324514 have disclosed toners including a release agent such as a candelilla wax, a higher fatty acid wax, a higher alcohol wax, natural plant waxes (a camauba wax, a rice wax), and a montan ester wax. However, these toners do not sufficiently satisfy low-temperature fixability, hot offset resistance, developability (chargeability), and durability. In general, when a release agent having a low-melting point is added to a toner, fluidity of the toner deteriorates, and therefore developability, transferability, chargeability, durability, and preservability thereof also deteriorate.

JP-As 11-258934, 11-258935, 04-299357, 04-337737, 06-208244, and 07-281478 have disclosed toners including two or more release agents so as to broaden the fixable temperature range (in which hot offset does not occur) thereof. However, these toners have a problem in dispersibility of the wax in the toner.

JP-A 08-166686 discloses a toner including a polyester resin and two offset inhibitors, each of which has an acid value and a different melting point. However, this toner has insufficient developability.

JP-As 08-328293 and 10-161335 have disclosed toners including wax particles having a specific particle diameter. However, the existential condition and location of the wax particles are undefined, and therefore the toner has insufficient separativeness when fixed.

JP-A 2001-305782 discloses a toner, on the surface of which spherical wax particles are fixed. When the wax particles are present on the surface of the toner, fluidity thereof deteriorates, and therefore developability, transferability, chargeability, durability, and preservability also deteriorate.

JP-A 2002-6541 discloses a toner in which wax particles are locally present near the surface of the toner particle, which is prepared by dispersing a heat-melted mixture including the wax, a condensation resin, and a colorant, in a hot water, followed by drying. When the melted mixture of the resin, the colorant, and the wax is dispersed in the hot water, the wax particles migrate to the surface region of the toner particle, and then the mixture is subjected to cooling so as to be solidified. In this case, the outermost region of the toner includes a larger amount of the wax than the inner adjacent region thereof. When the inner adjacent region includes a larger amount of the wax than the outermost region, the wax forms a continuous phase thereof but does not form domains thereof (as illustrated in FIG. 3 of JP-A 2002-6541). When the wax does not sufficiently migrate when melted, the wax present at the center of the toner increases (as illustrated in FIG. 2 of JP-A 2002-6541). It is described therein that the above-mentioned toner in which wax particles are locally present near the surface of the toner particle has good thermal stability when stored. However, the toner does not have sufficient resistances to mechanical and thermal stress applied thereto. The toner described in one or more Examples thereof includes a wax in an amount less than 1% by weight based on total weight of the toner, and therefore the wax tends not to adhere to a fixing member. However, the amount of the wax is too small to exert good separativeness when the toner is fixed, resulting in poor hot offset resistance of the toner.

JP-A 2002-91060 discloses a toner including a wax and having a core-shell structure. The shell is formed of a binder resin having a high glass transition temperature (Tg), and the core is formed of a binder resin having a low Tg and includes the wax therein. Since the wax is located in the center of the core covered with the shell formed of the binder resin having a high Tg, the wax cannot sufficiently exude to the surface of the toner, resulting in poor separativeness of the toner. When the amount of the wax is too large, the wax exuded from the toner is projected when an image is formed on an overhead projection (OHP) sheet, resulting in deterioration of image quality of the projected image.

JP-As 2004-145243 and 2004-318043 have disclosed toners in which specific amount of a wax is present near the surface of the toner. It is described therein that such a toner has good thermostable preservability and chargeability, while having good separativeness between a fixing member. No mention is made of whether the surface includes the wax. In either case, the wax is present very near the surface of the toner, and therefore the wax tends to release therefrom when a load is applied thereto in the image forming process for a long period of the time, resulting in contamination of a photoreceptor, a carrier, a developing roller, a controlling member, etc.

SUMMARY OF THE INVENTION

Accordingly, an object of the present invention is to provide a toner having a good combination of the following properties:

(1) thermostable preservability;

(2) fixing separativeness (i.e., a property in that a paper having a toner thereon is separated from a fixing member);

(3) transferability;

(4) capable of producing high quality images for overhead projection (OHP); and (5) stable chargeability (even if the toner is used for a process applying a dynamic load thereto, such as a non-magnetic one-component developing process).

Another object of the present invention is to provide a method of preparing the above toner.

These and other objects of the present invention, either individually or in combinations thereof, as hereinafter will become more readily apparent can be attained by a toner, comprising:

a binder resin;

a colorant; and a release agent, wherein the toner has a volume average particle diameter (Dv) of from 3 to 9 μm, and wherein the binder resin and the release agent form a sea-island structure in which the island formed of the release agent is dispersed in the sea formed of the binder resin in a cross-sectional image of the toner obtained by a transmission electron microscope (TEM), and the following relationships are satisfied:

$$TB>IA \text{ and } TB>IC$$

wherein IA represents an area ratio (%) of the island in an outermost region (A) of the cross-sectional image of the toner, having a thickness of 0.05 Dv; TB represents an area ratio (%) of the island in an intermediate region (B) thereof located under the outermost region (A), having a thickness of 0.15 Dv; and IC represents an area ratio (%) of the island in an innermost region (C) thereof located under the intermediate region (B).

BRIEF DESCRIPTION OF THE DRAWINGS

These and other objects, features and advantages of the present invention will become apparent upon consideration of the following description of the preferred embodiments of the present invention taken in conjunction with the accompanying drawings, wherein.

DETAILED DESCRIPTION OF THE INVENTION

Figure 1:
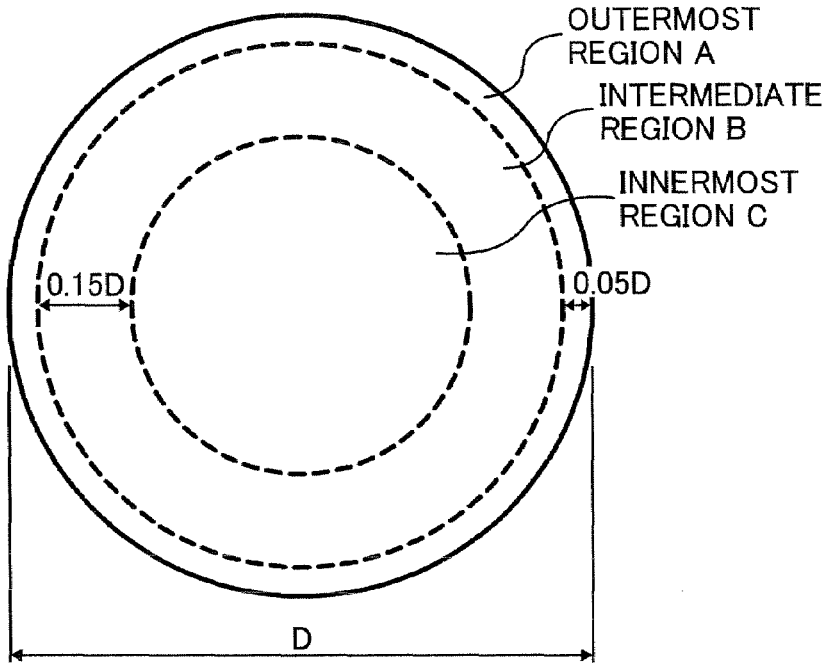
FIG. 1 is a cross-sectional view illustrating an embodiment of the toner of the present invention.

As described in JP-As 2002-6541, 2004-145243, and 2004-318043, a wax is preferably present near the surface region of the resultant toner, in view of improving separativeness when the toner is used for an oilless fixing process. On the other hand, when a wax is exposed at the surface of the toner or present near the surface region thereof, the wax tends to release from the toner when a mechanical stress is applied thereto in an image forming apparatus. The released wax tends to contaminate image forming members and deteriorates chargeability of the toner, resulting in deterioration of the resultant image quality. In order to prevent the wax from releasing from the toner, it is preferable that such the toner is evenly covered with a resin.

Toners disclosed in JP-As 2004-145243 and 2004-318043 are prepared by dissolving or dispersing toner constituents including a binder resin, a colorant, and a wax in an organic solvent to prepare an oil phase liquid, and then dispersing the oil phase liquid in an aqueous medium to prepare an O/W emulsion. In this case, the wax can be easily located near the surface region of the resultant toner because of its high hydrophobicity.

The toner of the present invention is prepared by forming colored resin particles in an O/W emulsion so that the wax is located near the surface region of the core particles, and then forming uniform resin layers on the colored resin particles. In this case, the wax is ideally dispersed in the resultant toner.

In the O/W emulsion, the wax moves away from the surrounding water due to its hydrophobicity and comes close to the binder resin. Since the binder resin is softened in the emulsion and has hydrophobicity, the wax penetrates into the binder resin. The wax may take various dispersing states according to the dispersing conditions of the oil phase and the properties of the dissolved or dispersed substance and the solvent. For example, when polarity of the binder resin is largely different from that of the wax, i.e., when the binder resin has a relatively high acid value and the wax has few polar groups, the wax tends to present near the surfaces of the droplets in the O/W emulsion. The mechanism of this phenomenon is unknown, but it is considered that permeability of the wax to the binder resin is so small because of the large difference in molecular structure therebetween that the binder resin and the wax separate with each other and the binder resin pushes out the wax to the interface between the water phase due to its aggregative force. When an excessive amount of a surfactant is included in the water phase, the wax particles may be dispersed alone therein. When the content of the surfactant is at critical micellar concentration or less, the wax cannot release from the surfaces of the droplets in the O/W emulsion and remains thereon.

By forming uniform resin layers on the surfaces of the thus prepared resin particles, a toner having a good combination of thermostable preservability, fixing separativeness, transferability, and durability to electrophotography, and capable of producing high quality OHP images.

FIG. 1 is a cross-sectional view illustrating an embodiment of the toner of the present invention for explaining how to determine regions (A), (B), and (C).

An outermost region (A) has a thickness of 0.05 times Dv (i.e., volume average particle diameter of the toner), an intermediate region (B) is located under the outermost region (A) and has a thickness of 0.15 times Dv, and an innermost region (C) is located under the intermediate region (B).

Figure 2:
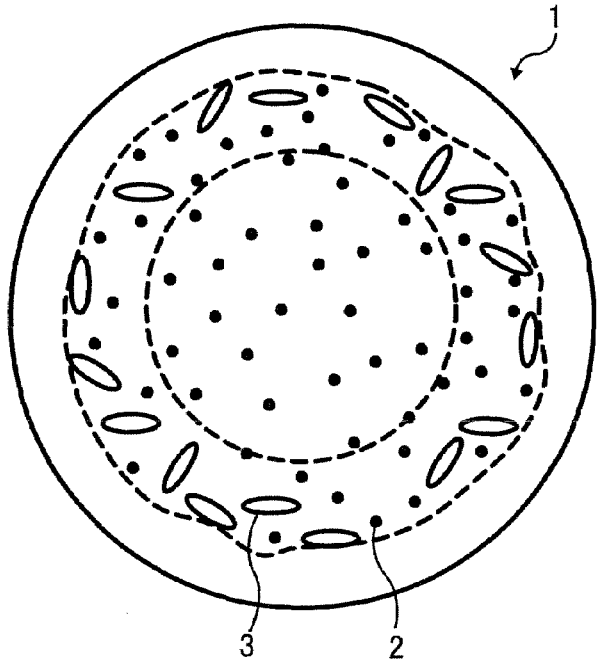
FIG. 2 is another cross-sectional view illustrating an embodiment of the toner of the present invention.

FIG. 2 is another cross-sectional view illustrating an embodiment of the toner of the present invention.

A toner 1 comprises a colorant 2, a release agent 3, and a binder resin. Most of the release agent 3 is included in the intermediate region (B).

As illustrated in FIG. 2, the release agent 3 forms domains having an island structure in the toner. If the release agent 3 does not form domains and forms a continuous phase, the toner is dynamically weakened. It is important that the release agent 3 forms domains thereof in the toner.

The outermost region (A) includes the release agent in an amount of from 0 to 5% by area, preferably from 0 to 2% by area, and more preferably the outermost region (A) includes no release agent. When the area of the release agent is too large, fluidity, chargeability, and thermostable preservability of the toner deteriorate. As a result, the resultant image quality deteriorates and the toner tends to overflow in the apparatus.

The intermediate region (B) includes the release agent in an amount of from 3 to 70% by area, preferably from 5 to 50% by area. When the area of the release agent is too large, the intermediate region (B) is dynamically weakened even if the release agent forms a sea-island structure. As a result, the toner is easily cracked and therefore chargeability thereof deteriorates. Fine particles produced by the cracking of the toner contaminate a controlling member, a photoreceptor, etc. and therefore chargeability thereof deteriorates. When an image is formed on an overhead projection (OHP) sheet, an excessive amount of the release agent tends to exude out from the image, and the projected image may have a smoky image noise. On the other hand, when the area of the release agent is too small, the toner cannot have sufficient separativeness especially used for an oilless fixing process.

The innermost region (C) includes the release agent in an amount of from 0 to 5% by area, preferably from 0 to 2% by area, and more preferably 0%. Since the innermost region (C) does not influence on the separativeness of the toner, the innermost region (C) preferably includes the release agent as few as possible. When the amount of the release agent is too large, the amount of the binder resin and the colorant relatively decreases, and therefore dispersibility of the colorant deteriorates. As a result, image density and color reproducibility of the resultant image deteriorate. When an image is formed on an overhead projection (OHP) sheet, an excessive amount of the release agent tends to cause a smoky image noise in the projected image.

In a cross section of the toner, the domain of the release agent has an average longest particle diameter of from 0.1 to 2.5 μm, preferably from 0.2 to 1.8 μm, and more preferably from 0.3 to 1.5 μm. When the average longest particle diameter is too large, the release agent is unevenly dispersed in the toner, resulting in deterioration of charging stability and thermostable preservability. When the average longest particle diameter is too small, the release agent exudes from the toner too slowly, and therefore the toner shows poor separativeness when fixed.

The average value of the shortest distance between the closest domains of the release agent is preferably not less than 0.05 μm, more preferably not less than 0.1 μm, and much more preferably not less than 0.2 μm. When the shortest distance is too small, stiffness of the toner deteriorates. As a result, the toner is easily cracked, and therefore chargeability and fluidity thereof deteriorate.

Each of the intermediate region (B) and the innermost region (C) preferably includes a binder resin (R1), and the outermost region (A) preferably includes a binder resin (R2). The binder resin (R1) preferably includes a resin (R11) having a polyester skeleton, and the binder resin (R2) preferably includes a vinyl copolymer resin (V). The intermediate region (B) and the innermost region (C), which form the main body of the toner, are formed of a polyester resin having an advantage in improving low-temperature fixability and thermostable preservability of the toner. The outermost region (A), which forms the surface region of the toner, is formed of a vinyl copolymer resin having an advantage in controlling chargeability of the toner.

The reasons why the vinyl copolymer resin (V) has an advantage in controlling chargeability of the toner are as follows.

(1) Plural kinds of monomers can be polymerized. Various kinds of monomers can be used (i.e., Having high flexibility in choosing monomers). For example, polar groups (such as carboxylic acid group and sulfonic acid group) are easily introduced.

(2) A functional group originated from a monomer can be efficiently located at the surface of the resultant toner. For example, the structure of the resultant particulate polymer can be controlled by a polarity of a monomer, in emulsification polymerizations and suspension polymerizations.

For the above reason, the toner has both good fixability (i.e., low temperature fixability) and chargeability (i.e., developability and transferability). The weight ratio (i.e., (A)/((B)+(C))) of the outermost region (A) (hereinafter referred to as the shell region) to the sum of the intermediate region (B) and the innermost region (C) (these combined regions are hereinafter referred to as the core region) is preferably 0.05 to 0.5, more preferably from 0.07 to 0.4, and much more preferably from 0.1 to 0.3. When the weight ratio is too small, the binder resin (R2) including the vinyl copolymer resin (V) cannot sufficiently exert its effect. When the weight ratio is too large, the toner includes too small an amount of the binder resin (R1) including the resin (R11) having a polyester skeleton, and therefore fixability of the toner deteriorates.

The toner preferably has a volume average particle diameter of from 3 to 9 μm, and more preferably from 4 to 8 μm. When the volume average particle diameter is too small, the toner tends to cause various troubles in image forming process. When the volume average particle diameter is too large, resolution of the resultant image deteriorates.

The toner of the present invention preferably has a ½ method temperature (T½) of from 110 to 140° C., and more preferably from 125 to 135° C., measured by a flow tester. When the T½ is too small, hot offset problem easily occurs, and therefore smoothness of the surface of the fixed image decreases. As a result, glossiness of the resultant image deteriorates. When the T½ is too large, cold offset problem tends to occur in that the toner cannot be sufficiently fixed on a paper and remains on a fixing member.

The toner preferably has a nearly spherical shape. The toner preferably has an average circularity of from 0.930 to 0.995, and more preferably from 0.955 to 0.995. When the average circularity is too small, transferability of the toner deteriorates.

Polyester Resin

As the resin (R11) having a polyester skeleton, any known resins can be used and are not particularly limited. A mixture of plural resins can also be used. Specific examples of the resin (R11) having a polyester skeleton include, but are not limited to, polycondensation products of a polyol (1) with a polycarboxylic acid (2).

(Polyol)

Specific examples of the polyol (1) include, but are not limited to, alkylene glycols (e.g., ethylene glycol, 1,2-propylene glycol, 1,3-propylene glycol, 1,4-butanediol, 1,6-hexanediol), alkylene ether glycols (e.g., diethylene glycol, triethylene glycol, dipropylene glycol, polyethylene glycol, polypropylene glycol, polytetramethylene ether glycol), alicyclic diols (e.g., 1,4-cyclohexanedimethanol, hydrogenated bisphenol A), bisphenols (e.g., bisphenol A; bisphenol F; bisphenol S; 4,4'-dihydroxybiphenyls (e.g., 3,3'-difluoro-4,4'-dihydroxybiphenyl); bis(hydroxyphenyl)alkanes (e.g., bis(3-fluoro-4-hydroxyphenyl)methane, 1-phenyl-1,1-bis(3-fluoro-4-hydroxyphenyl)ethane, 2,2-bis(3-fluoro-4-hydroxyphenyl)propane, 2,2-bis(3,5-difluoro-4-hydroxyphenyl)propane (i.e., tetrafluoro bisphenol A), 2,2-bis(3-hydroxyphenyl)-1,1,1,3,3,3-hexafluoropropane); bis(4-hydroxyphenyl)ethers (e.g., bis(3-fluoro-4-hydroxyphenyl)ether)), adducts of the above-mentioned alicyclic diols with an alkylene oxide (e.g., ethylene oxide, propylene oxide and butylenes oxide), adducts of the above mentioned bisphenols with an alkylene oxide (e.g., ethylene oxide, propylene oxide and butylenes oxide), etc.

Among these, alkylene glycols having 2 to 12 carbon atoms and adducts of bisphenols with an alkylene oxide are preferably used, and adducts of bisphenols with an alkylene oxide and mixture thereof with alkylene glycols having 2 to 12 carbon atoms are more preferably used.

Further, multivalent aliphatic alcohols having three or more valences (e.g., glycerin, trimethylolethane, trimethylolpropane, pentaerythritol, sorbitol), phenols having three or more valences (e.g., trisphenol PA, phenol novolac, cresol novolac), and adducts of the above-mentioned phenols having three or more valences with an alkylene oxide can be used.

These polyols can be used alone or in combination.

(Polycarboxylic Acid)

Specific examples of the polycarboxylic acid (2) include, but are not limited to, alkylene dicarboxylic acids (e.g., succinic acid, adipic acid, sebacic acid), alkenylene dicarboxylic acids (e.g., maleic acid, fumaric acid), aromatic dicarboxylic acids (e.g., phthalic acid, isophthalic acid, terephthalic acid, naphthalene dicarboxylic acid, 3-fluoroisophthalic acid, 2-fluoroisophthalic acid, 2-fluoroterephthalic acid, 2,4,5,6-tetrafluoroisophthalic acid, 2,3,5,6-tetrafluoroterephthalic acid, 5-trifluoromethylisophthalic acid, 2,2-bis(4-carboxyphenyl)hexafluoropropane, 2,2-bis(3-carboxyphenyl) hexafluoropropane, 2,2'-bis(trifluoromethyl)-4,4'-biphenyldicarboxylic acid, 3,3'-bis(trifluoromethyl)-4,4'-biphenyldicarboxylic acid, 2,2'-bis(trifluoromethyl)-3,3'-biphenyldicarboxylic acid, hexafluoroisopropylidene diphthalic anhydride), etc.

Among these, alkenylene dicarboxylic acids having 4 to 20 carbon atoms and aromatic dicarboxylic acids having 8 to 20 carbon atoms are preferably used.

Further, as polycarboxylic acids having three or more valences, aromatic polycarboxylic acids having 9 to 20 carbon atoms (e.g., trimellitic acid, pyromellitic acid) and acid anhydrides and lower alkyl esters (e.g., methyl ester, ethyl ester, isopropyl ester) thereof can be used.

These polycarboxylic acids can be used alone or in combination.

(Ratio Between Polyol and Polycarboxylic Acid)

A polyol (1) and a polycarboxylic acid (2) are mixed so that the equivalent ratio ([OH]/[COOH]) between a hydroxyl group [OH] and a carboxylic group [COOH] is typically from 2/1 to 1/1, preferably from 1.5/1 to 1/1, and more preferably from 1.3/1 to 1.02/1.

(Molecular Weight of (R11))

The resin (R11) having a polyester skeleton has a peak weight-average molecular weight of from 1,000 to 30,000, preferably from 1,500 to 10,000, and more preferably from 2,000 to 8,000. When the peak molecular weight is too small, thermostable preservability of the toner deteriorates. When the peak molecular weight is too large, low-temperature fixability of the toner deteriorates.

Vinyl Copolymer Resin

As the vinyl copolymer resin (V), any known resins can be used and are not particularly limited. A mixture of plural resins can also be used.

The vinyl copolymer resin (V) preferably has a weight average molecular weight of not larger than 50,000, and more preferably not larger than 30,000. When the weight average molecular weight is too large, low-temperature fixability of the toner deteriorates.

The vinyl copolymer resin (V) preferably has a glass transition temperature of from 40 to 80° C., and more preferably from 50 to 70° C. When the glass transition temperature is too large, low-temperature fixability of the toner deteriorates. When the glass transition temperature is too small, thermostable preservability of the toner deteriorates.

The vinyl copolymer (V) is prepared by copolymerizing vinyl monomers. Specific preferred examples of suitable vinyl monomers are shown as follows.

(1) Vinyl Hydrocarbons:

aliphatic vinyl hydrocarbons such as alkenes (e.g., ethylene, propylene, butene, isobutylene, pentene, heptene, diisobutylene, octene, dodecene, octadecene, other α-olefins except the above-mentioned compounds) and alkadienes (e.g., butadiene, isoprene, 1,4-pentadiene, 1,6-hexadiene, 1,7-octadiene);

alicyclic vinyl hydrocarbons such as monocycloalkenes, dicycloalkenes, and alkadienes (e.g., cyclohexene, (di)cyclopentadiene, vinylcyclohexene, ethylidenebicycloheptene);

and terpenes (e.g., pinene, limonene, indene); and aromatic vinyl hydrocarbons such as styrene and hydrocarbonic (alkyl, cycloalkyl, aralkyl and/or alkenyl) derivatives thereof (e.g., a-methylstyrene, vinyltoluene, 2,4-dimethylstyrene, ethylstyrene, isopropylstyrene, butylstyrene, phenylstyrene, cyclohexylstyrene, benzylstyrene, crotylbenzene, divinylbenzene, divinyltoluene, divinylxylene, trivinylbenzene), and vinylnaphthalene;

(2) Vinyl monomers including carboxyl group and salts thereof:

unsaturated monocarboxylic or dicarboxylic acids having 3 to 30 carbon atoms and anhydrides and monoalkyl (1 to 24 carbon atoms) esters thereof (e.g., (meth)acrylic acid, maleic acid, maleic anhydride, monoalkyl maleate, fumaric acid, monoalkyl fumarate, crotonic acid, itaconic acid, monoalkyl itaconate, itaconic glycol monoether, citraconic acid, monoalkyl citraconate, cinnamic acid);

(3) Vinyl monomers including sulfonic group and vinyl monoesters of sulfuric acid, and salts thereof:

alkene sulfonic acids having 2 to 14 carbon atoms (e.g., vinyl sulfonic acid, (meth)allyl sulfonic acid, methyl vinyl sulfonic acid, styrene sulfonic acid), and alkyl derivatives thereof having 2 to 24 carbon atoms (e.g., α-methylstyrene sulfonic acid); sulfo(hydroxy)alkyl (meth)acrylates or (meth)acrylamides (e.g., sulfopropyl (meth)acrylate, 2-hydroxy-3-(meth)acryloxypropyl sulfonic acid, 2-(meth) acryloylamino-2,2-dimethylethane sulfonic acid, 2-(meth) acryloyloxyethane sulfonic acid, 3-(meth)acryloyloxy-2-hydroxypropane sulfonic acid, 2-(meth)acrylamide-2-methylpropane sulfonic acid, 3-(meth)acrylamide-2-hydroxypropane sulfonic acid, alkyl(3 to 18 carbon atoms) allylsulfo succinic acid, sulfuric acid ester of poly(n is 2 to 30)oxyalkylene (ethylene, propylene, butylene and mono, random and block copolymers thereof) mono(meth)acrylate such as sulfuric acid ester of poly(n is 5 to 15)oxypropylene monomethacrylate, sulfuric acid esters of polyoxyethylene polycyclic phenylether); and salts thereof;

(4) Vinyl monomers including phosphate group and salts thereof:

(meth)acryloyloxyalkyl phosphoric acid monoesters (e.g., 2-hydroxyethyl(meth)acryloyl phosphate, phenyl-2-acryloyloxyethyl phosphate); (meth)acryloyloxyalkyl(1 to 24 carbon atoms) phosphonic acids (e.g., 2-acryloyloxyethyl phosphonic acid); and salts thereof.

Specific examples of the above-mentioned salts of monomers shown in the above paragraphs (2) to (4) include alkali metal salts (e.g., sodium salts, potassium salts), alkaline-earth metal salts (e.g., calcium salts, magnesium salts), ammonium salts, amine salts and quaternary ammonium salts.

(5) Vinyl monomers including hydroxyl group:

hydroxystyrene, N-methylol(meth)acrylamide, hydroxyethyl(meth)acrylate, hydroxypropyl(meth)acrylate, polyethyleneglycol mono(meth)acrylate, (meth)allylalcohol, crotyl alcohol, isocrotyl alcohol, 1-butene-3-ol, 2-butene-1-ol, 2-butene-1,4-diol, propargyl alcohol, 2-hydroxyethyl propenyl ether, and sucrose allyl ether;

(6) Vinyl monomers including nitrogen:

vinyl monomers including amino group (e.g., aminoethyl (meth)acrylate, dimethylaminoethyl(meth)acrylate, diethylaminoethyl(meth)acrylate, t-butylaminoethyl (meth)acrylate, N-aminoethyl(meth)acrylamide, (meth) acrylamine, morpholinoethyl(meth)acrylate, 4-vinylpyridine, 2-vinylpyridine, crotylamine, N,N-dimethylaminostyrene, methyl-α-acetoamino acrylate, vinylimidazole, N-vinylpyrrol, N-vinylthiopyrrolidone, N-arylphenylenediamine, aminocarbazole, aminothiazole, aminoindole, aminopyrrol, aminoimidazole, aminomercaptothiazole, and salts thereof);

vinyl monomers including amide group (e.g., (meth)acrylamide, N-methyl(meth)acrylamide, N-butylacrylamide, diacetoneacrylamide, N-methylol(meth)acrylamide, N,N-methylene-bis(meth)acrylamide, cinammic acid amide, N,N-dimethylacrylamide, N,N-dibenzylacrylamide, methacrylformamide, N-methyl-N-vinylacetamide, N-vinylpyrrolidone);

vinyl monomers including nitrile group (e.g., (meth)acrylonitrile, cyanostyrene, cyanoacrylate);

vinyl monomers including quaternary ammonium cation group such as quaternary compounds of vinyl monomers (e.g., dimethylaminoethyl(meth)acrylate, diethylaminoethyl(meth)acrylate, dimethylaminoethyl(meth)acrylamide, diethylaminoethyl(meth)acrylamide, diallylamine) including tertiary amine group produced by using quaternate agent (e.g., methyl chloride, dimethyl sulfonic acid, benzyl chloride, dimethyl carbonate); and vinyl monomers including nitro group (e.g., Nitrostyrene);

(7) Vinyl monomers including epoxy group:

Glycidyl(meth)acrylate, tetrahydrofurfuryl(meth)acrylate, p-vinylphenylphenyloxide;

(8) Vinylesters, vinyl(thio)ethers, vinylketones, vinylsulfones:

vinylesters (e.g., vinyl acetate, vinyl butyrate, vinyl propionate, diallyl phthalate, diallyl adipate, isopropenyl acetate, vinyl methacrylate, methyl-4-vinyl benzoate, cyclohexyl methacrylate, benzyl methacrylate, phenyl (meth)acrylate, vinylmethoxy acetate, vinyl benzoate, ethyl-α-ethoxy acrylate, alkyl (meth)acrylates including alkyl group having 1 to 50 carbon atoms (such as methyl (meth)acrylate, ethyl(meth)acrylate, propyl(meth)acrylate, butyl(meth)acrylate, 2-ethylhexyl(meth)acrylate, dodecyl(meth)acrylate, hexadecyl(meth)acrylate, heptadecyl(meth)acrylate, and eicocyl(meth)acrylate), dialkyl fumarates (2 alkyl groups have 2 to 8 carbon atoms and have straight-chain, branched-chain or alicyclic structure), dialkyl maleates (2 alkyl groups have 2 to 8 carbon atoms and have straight-chain, branched-chain or alicyclic structure), poly(meth)allyloxyalkanes (such as diallyloxyethane, triallyloxyethane, tetraallyloxyethane, tetraallyloxypropane, tetraallyloxybutane, and tetramethallyloxyethane), vinyl monomers including polyalkyleneglycol chain (such as polyethyleneglycol(molecular weight of 300) mono(meth)acrylate, polypropyleneglycol(molecular weight of 500) monoacrylate, adduct of methy alcohol (meth)acrylate with 10 mols of ethyleneoxide, and adduct of lauryl alcohol(meth)acrylate with 30 mols of ethyleneoxide), and poly(meth)acrylates ((meth) acrylates of polyalcohols such as ethyleneglycol di(meth) acrylate, propyleneglycol di(meth)acrylate, neopentylglycol di(meth)acrylate, trimethylolpropane tri(meth) acrylate, and polyethyleneglycol di(meth)acrylate));

vinyl(thio)ethers (e.g., vinylmethylether, vinylethylether, vinylpropylether, vinylbutylether, vinyl-2-ethylhexylether, vinylphenylether, vinyl-2-methoxyethylether, methoxybutadiene, vinyl-2-butoxyethylether, 3,4-dihydro-1,2-pyran, 2-butoxy-2'-vinyloxydiethylether, vinyl-2-ethylmercaptoethylether, acetoxystyrene, phenoxystyrene);

vinylketones (e.g., vinyl methyl ketone, vinyl ethyl ketone, vinyl phenyl ketone); and vinylsulfones (e.g., divinylsulfide, p-vinyldiphenylsulfide, vinylethylsulfide, vinylethylsulufone, divinylsulfone, divinylsulfoxide);

(9) Another vinyl monomers:

isocyanatoethyl(meth)acrylate, and m-isopropenyl-α,α-dimethylbenzylisocyanate.

(10) Vinyl monomers including fluorine:

4-fluorostyrene, 2,3,5,6-tetrafluorostyrene, pentafluorophenyl(meth)acrylate, pentafluorobenzyl(meth)acrylate, perfluorohexyl(meth)acrylate, perfluorocyclohexylmethyl (meth)acrylate, 2,2,2-trifluoroethyl(meth)acrylate, 2,2,3,3-tetrafluoropropyl(meth)acrylate, 1H,1H,4H-hexafluorobutyl(meth)acrylate, 1H,1H,5H-octafluoropentyl(meta)acrylate, 1H,1H,7H-dodecafluoroheptyl(meth)acrylate, perfluorooctyl(meth) acrylate, 2-perfluorooctylethyl(meth)acrylate, heptadecafuluorodecyl(meth)acrylate, trihydroperfluoroundecyl(meth)acrylate, perfluoronorbornylmethyl (meth)acrylate, 1H-perfluoroisobornyl(meth)acrylate, 2-(N-butylperfluorooctanesulfoneamide)ethyl(meth) acrylate, 2-(N-ethylperfluorooctanesulfoneamide)ethyl (meth)acrylate, derivatives of α-fluoroacrylic acid;

bis-hexafluoroisopropyl itaconate, bis-hexafluoroisopropyl maleate, bis-perfluorooctyl itaconate, bis-perfluorooctyl maleate, bis-trifluoroethyl itaconate, bis-trifluoroethyl maleate;

vinylheptafluoro butyrate, vinylperfluoro heptanoate, vinylperfluoro nonanoate, vinylperfluoro octanoate, etc.

Specific examples of the vinyl copolymer resin (V) include copolymers of two or more vinyl monomers shown in the above paragraphs (1) to (10) at any mixing ratio such as styrene-(meth)acrylate copolymer, styrene-butadiene copolymer, (meth)acrylic acid-acrylate copolymer, styrene-acrylonitrile copolymer, styrene-maleic anhydride copolymer, styrene-(meth)acrylic acid copolymer, styrene-(meth) acrylic acid-divinylbenzene copolymer, and styrene-styrene sulfonic acid-(meth)acrylate copolymer.

Modified Polyester Resin (R12)

The binder resin (R1) may include a modified polyester resin (R12) having a urethane and/or urea bond so as to control viscosity of the toner for the purpose of improving offset resistance. The binder resin (R1) preferably includes the modified polyester resin (R12) having a urethane and/or urea bond in an amount of not larger than 20%, more preferably not larger than 15%, and much more preferably not larger than 10%. When the amount is too large, low-temperature fixability of the toner deteriorates. The modified polyester resin (R12) having a urethane and/or urea bond can be directly mixed with the binder resin (R1). However, in terms of manufacturability, the modified polyester resin is preferably prepared by mixing and reacting (i.e., elongating and/or cross-linking) a modified polyester resin (R13) having an isocyanate group at its end and having relatively low molecular weight ((R13) is hereinafter referred to as prepolymer or precursor) with an amine capable of reacting with the prepolymer so that a modified polyester resin (R14) having a urethane and/or urea bond is prepared. In this case, the modified polyester resin having relatively high molecular weight can be easily included in the core region (i.e., the intermediate region (B) and the innermost region (C)).

The modified polyester resin (R12) having a urethane and/or urea bond can be mixed with an unmodified polyester resin.

(Prepolymer)

The prepolymer having an isocyanate group (i.e., modified polyester resin (R13) having an isocyanate group at its end) is formed by a reaction between a polyisocyanate (3) and a polyester having an active hydrogen group which is formed by the polycondensation reaction between the polyol (1) and the polycarboxylic acid (2). Specific examples of the active hydrogen group included in the polyester include, but are not limited to, hydroxyl group (alcoholic hydroxyl group and phenolic hydroxyl group), amino group, carboxyl group, mercapto group, etc. Among these, alcoholic hydroxyl group is preferably selected.

(Polyisocyanate)

Specific examples of the polyisocyanate (3) include, but are not limited to, aliphatic polyisocyanates (e.g., tetramethylenediisocyanate, hexamethylenediisocyanate, 2,6-diisocyanatemethylcaproate); alicyclic polyisocyanates (e.g., isophoronediisocyanate, cyclohexylmethanediisocyanate); aromatic diisocyanates (e.g., tolylenediisocyanate, diphenylmethanediisocyanate); aromatic aliphatic diisocyanates ($\alpha,\alpha,\alpha',\alpha'$,-tetramethylxylylenediisocyanate); isocyanurates; the above-mentioned polyisocyanates blocked with phenol derivatives, oxime and caprolactam; and their combinations. These can be used alone or in combination.

(Ratio Between Isocyanate Group and Hydroxyl Group)

A polyisocyanate (3) is mixed with a polyester such that the equivalent ratio ([NCO]/[OH]) between an isocyanate group [NCO] and a hydroxyl group [OH] included in the polyester is typically from 5/1 to 1/1, preferably from 4/1 to 1.2/1, and more preferably from 2.5/1 to 1.5/1. When the ratio [NCO]/[OH] is too large, low-temperature fixability of the resultant toner deteriorates. When the ratio [NCO]/[OH] is too small, the urea content in the resultant modified polyester decreases and hot offset resistance of the resultant toner deteriorates. The content of the constitutional unit obtained from a polyisocyanate (3) in the polyester prepolymer (A) (having a polyisocyanate group at its ends) is from 0.5 to 40% by weight, preferably from 1 to 30% by weight, and more preferably from 2 to 20% by weight. When the content is too small, hot offset resistance of the resultant toner deteriorates. In contrast, when the content is too large, low-temperature fixability of the resultant toner deteriorates.

(Number of Isocyanate Groups in Prepolymer)

The number of the isocyanate groups included in a molecule of the polyester prepolymer is at least 1, preferably from 1.5 to 3 on average, and more preferably from 1.8 to 2.5 on average. When the number of isocyanate groups is less than 1 per molecule, the molecular weight of the modified polyester after an elongation and/or a crosslinking reaction decreases and the hot offset resistance of the resultant toner deteriorates.

(Elongation and/or Crosslinking Agent)

In the present invention, amines (B) can be used as an elongation and/or crosslinking agent. Specific examples of the amines (B) include, but are not limited to, diamines (B1), polyamines (B2) having three or more amino groups, amino alcohols (B3), amino mercaptans (B4), amino acids (B5), and blocked amines (B6) in which the amino groups in the amines (B1) to (B5) are blocked.

Specific examples of the diamines (B1) include, but are not limited to, aromatic diamines (e.g., phenylene diamine, diethyltoluene diamine, 4,4'-diaminodiphenyl methane, tetrafluoro-p-xylylene diamine, tetrafluoro-p-phenylene diamine), alicyclic diamines (e.g., 4,4'-diamino-3,3'-dimethyldicyclohexyl methane, diaminocyclohexane isophoronediamine), aliphatic diamines (e.g., ethylene diamine, tetrametylene diamine, hexamethylene diamine, dodecafluorohexylene diamine, tetracosafluorododecylene diamine), etc.

Specific examples of the polyamines (B2) having three or more amino groups include, but are not limited to, diethylene triamine, triethylene tetramine.

Specific examples of the amino alcohols (B3) include, but are not limited to, ethanol amine, hydroxyethyl aniline, etc.

Specific examples of the amino mercaptan (B4) include aminoethyl mercaptan, aminopropyl mercaptan, etc.

Specific examples of the amino acids (B5) include, but are not limited to, amino propionic acid, amino caproic acid, etc.

Specific examples of the blocked amines (B6) include, but are not limited to, ketimine compounds which are prepared by reacting one of the above-mentioned amines (B1) to (B5) with a ketone (e.g., acetone, methyl ethyl ketone, methyl isobutyl ketone), oxazoline compounds, etc.

(Reaction Stopping Agent)

The molecular weight of the modified polyester can optionally be controlled using a reaction stopping agent which stop an elongation and/or cross-linking reaction, if desired. Specific examples of the reaction stopping agent include, but are not limited to, monoamines (e.g., diethyl amine, dibutyl amine, butyl amine, lauryl amine), blocked amines (i.e., ketimine compounds prepared by blocking the monoamines mentioned above), etc.

(Ratio Between Amino Group and Isocyanate Group)

The mixing ratio (i.e., a ratio [NCO]/[NHx]) of the content of the prepolymer (A) having an isocyanate group to the amine (B) is from 1/2 to 2/1, preferably from 1/1.5 to 1.5/1, and more preferably from 1/1.2 to 1.2/1. When the mixing ratio is too large or too small, the molecular weight of the urea-modified polyester decreases, resulting in deterioration of hot offset resistance of the resultant toner.

Colorant

Specific examples of the colorants for use in the toner of the present invention include any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, etc. These materials can be used alone or in combination. The toner preferably includes a colorant in an amount of from 1 to 15% by weight, and more preferably from 3 to 10% by weight.

The colorant for use in the present invention can be combined with a resin to be used as a master batch. Specific examples of the resin for use in the master batch include, but are not limited to, the above-mentioned modified and unmodified polyester resins, styrene polymers and substituted styrene polymers (e.g., polystyrenes, poly-p-chlorostyrenes, polyvinyltoluenes), styrene copolymers (e.g., styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloro methacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic acid ester copolymers), polymethyl methacrylates, polybutyl methacrylates, polyvinyl chlorides, polyvinyl acetates, polyethylenes, polypropylenes, polyesters, epoxy resins, epoxy polyol resins, polyurethanes, polyamides, polyvinyl butyrals, polyacrylic acids, rosins, modified rosins, terpene resins, aliphatic or alicyclic hydrocarbon resins, aromatic petroleum resins, chlorinated paraffins, paraffin waxes, etc. These resins can be used alone or in combination.

The master batches can be prepared by mixing one or more of the resins as mentioned above and the colorant as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent (and water, if desired) is removed, can be preferably used because the resultant wet cake can be used as it is without being dried. When performing the mixing and kneading process, dispersing devices capable of applying a high shearing force such as three roll mills can be preferably used.

Release Agent

Any known release agents can be used for the toner of the present invention. Specific examples of the release agents include, but are not limited to, polyolefin waxes (e.g., polyethylene waxes, polypropylene waxes), hydrocarbons having a long chain (e.g., paraffin waxes, SASOL waxes), and waxes having a carbonyl group. Specific examples of the waxes having a carbonyl group include, but are not limited to, esters of polyalkanoic acids (e.g., camauba waxes, montan waxes, trimethylolpropane tribehenate, pentaerythritol tetrabehenate, pentaerythritol diacetate dibehenate, glycerin tribehenate, 1,18-octadecanediol distearate); polyalkanol esters (e.g., tristearyl trimellitate, distearyl maleate); polyalkanoic acid amides (e.g., ethylenediamine dibehenyl amide); polyalkylamides (e.g., trimellitic acid tristearylamide); and dialkyl ketones (e.g., distearyl ketone). Among these waxes having a carbonyl group, polyalkanoic acid esters are preferably used.

In the present invention, waxes having low polarity are preferably used. In particular, hydrocarbon waxes such as polyethylene waxes, polypropylene waxes, paraffin waxes, SASOL waxes, microcrystalline waxes, and Fisher-Tropsch waxes are preferably used.

The toner includes the release agent in an amount of from 3 to 15% by weight, preferably from 4 to 12% by weight, and more preferably from 5 to 10% by weight, based on total weight of the binder resin. When the amount is too small, the wax cannot sufficiently exert its effect, and therefore hot offset easily occurs. When the amount is too large, the wax, which melts at low temperatures, tends to exude from the toner due to the application of thermal and mechanical energies to the toner when agitated in a developing device, and contaminate a toner layer controlling member and a photoreceptor, etc., resulting in causing noise in the resultant image. In this case, the wax exuded from the toner is projected when an image is formed on an overhead projection (OHP) sheet, resulting in deterioration of image quality of the projected image.

When the wax is subjected to a temperature rising scan of a differential scanning calorimeter (DSC), an endothermic peak is observed in a temperature range of from 60 to 90° C., and preferably from 65 to 80° C. When the temperature is too small, fluidity and thermostable preservability of the toner deteriorate. When the temperature is too large, fixability of the toner deteriorates.

The endothermic peak, which is observed in a temperature rising scan of a differential scanning calorimeter (DSC), preferably has a half bandwidth of not larger than 8° C., and more preferably not larger than 6° C. When the half bandwidth is too large, i.e., the endothermic peak is too broad, fluidity and thermostable preservability of the toner deteriorate.

The toner of the present invention satisfies the following relationship:

$$(1/3)Dp \leqq Dw \leqq (2/3)Dp$$

wherein Dp (μm) represents the number average particle diameter of the toner and Dw (μm) represents the average particle diameter of the release agent.

The number average particle diameter (Dp) a toner can be measured using an instrument COULTER COUNTER TA-II or COULETR MULTISIZER II from Coulter Electrons Inc.

The measuring method is as follows:

(1) a surfactant is added as a dispersant to an electrolyte;

(2) a toner is added in the electrolyte and dispersed using an ultrasonic dispersing machine to prepare a toner suspension liquid;

(3) the number of toner particles are measured by the above instrument using an aperture to determine number distribution thereof, and (4) the number average particle diameter (Dp) is determined.

The average particle diameter (Dw) of the release agent is measured as follows:

(1) a toner is immersed in a solvent (such as chloroform) in which the binder resin of the toner can be dissolved;

(2) the solvent is subject to centrifugal separation so that wax particles are suspended;

(3) the suspended wax particles are collected and photographed by a scanning electron microscope to determine the particle diameter distribution of the wax particles.

When a toner satisfies the above relationship, the toner has good fixing separativeness. Such a toner also tends not to form films thereof on the photoreceptor and adhere to the blade.

Charge Controlling Agent

The toner of the present invention may optionally include a charge controlling agent.

Specific examples of the charge controlling agent include any known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, and salicylic acid derivatives, but are not limited thereto.

Specific examples of commercially available charge controlling agents include, but are not limited to, BONTRON® N-03 (Nigrosine dyes), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

External Additive (Particulate Inorganic Material)

Particulate inorganic materials are used as an external additive so as to impart fluidity, developability, chargeability, etc. to the resultant toner. The particulate inorganic material preferably has a primary particle diameter of from 5 nm to 2 μm, and more preferably from 5 to 500 nm, and a BET specific surface area of from 20 to 500 $m^2/g$. The content of the particulate inorganic material is preferably from 0.01 to 5.0% by weight, and more preferably from 0.01 to 2.0% by weight, based on the total weight of the toner. Specific examples of the particulate inorganic materials include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

(Particulate Polymer)

Particulate polymers of polystyrenes prepared by a soap-free polymerization, a suspension polymerization, and a dispersion polymerization; polycondensation polymers (e.g., methacrylates, acrylate copolymers, silicone resins, benzoguanamine resins, nylon); and thermosetting resins can also be used as the external additive.

(Surface Treatment of External Additive)

The above particulate inorganic materials are preferably surface-treated to improve the hydrophobicity thereof. Such a surface-treated inorganic material can prevent deterioration of fluidity and chargeability of the toner even under high humidity conditions. Specific examples of surface treatment agents include, but are not limited to, silane coupling agents, silylation agents, silane coupling agents having a fluorinated alkyl group, organic titanate coupling agents, aluminum coupling agents, silicone oils, modified silicone oils, etc.

(Cleanability Improving Agent)

A cleanability improving agent can be added to the toner so as to remove toner particles remaining on the surface of a photoreceptor or a primary transfer medium after a toner image is transferred. Specific examples of the cleanability improving agents include, but are not limited to, fatty acids and metal salts thereof such as stearic acid, zinc stearate, and calcium stearate; and particulate polymers such as polymethyl methacrylate and polystyrene, which are manufactured by a method such as soap-free emulsion polymerization methods. Particulate resins having a relatively narrow particle diameter distribution and a volume average particle diameter of from 0.01 to 1 μm are preferably used as the cleanability improving agent.

Method of Preparing Toner

Next, the method of preparing the toner of the present invention will be explained. The toner is preferably prepared by the following method, but is not limited thereto.

The toner of the present invention can be prepared by a method comprising:

dissolving or dispersing a polyester resin or a precursor thereof, a colorant, and a release agent in an organic solvent to prepare a core constituent liquid;

dispersing the core constituent liquid in an aqueous medium to prepare a first dispersion containing core particles; and adding a second dispersion containing a particulate vinyl copolymer resin to the first dispersion to adhere the particulate vinyl copolymer resin to the core particles.

Preparation of Core Particle (Organic Solvent)

Volatile solvents having a boiling point of lower than 100° C. are preferably used so as to be easily removed after the granulating process. Specific examples of the volatile solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These solvents can be used alone or in combination. In particular, ester solvents such as methyl acetate and ethyl acetate, aromatic solvents such as toluene and xylene, and halogenated hydrocarbons such as methylene chloride, 1,2-dichloroethane, chloroform and carbon tetrachloride are preferably used. The toner constituents, i.e., the polyester resin or the precursor thereof, the colorant and the release agent can be dissolved or dispersed simultaneously, however, these are dissolved or dispersed respectively in general. The solvent used in the respective dissolution or dispersion liquid can be the same or different, but it is preferable to use the same solvent in each dissolution or dispersion liquid so as to be easily removed.

(Dissolution or Dispersion of Polyester Resin or Precursor Thereof)

The dissolution or dispersion liquid of the polyester resin or the precursor thereof preferably has a resin content of from 40 to 80%. When the resin content is too high, dissolution or dispersion cannot be well performed because of high viscosity of the liquid. When the resin content is too low, manufacturability of the toner deteriorates. When the modified polyester resin having an isocyanate group at its ends (i.e., prepolymer) is mixed with the polyester resin, these can be dissolved or dispersed simultaneously in the same liquid, or separately in the different liquids. However, it is preferable that the prepolymer and the polyester resin are dissolved or dispersed separately in the different liquids because solubility and viscosity of each material are different.

(Dissolution or Dispersion of Colorant)

The colorant can be dissolved or dispersed in the solvent alone, or with the polyester resin, optionally with a dispersibility improving agent and another polyester resin. In addition, the master batch of the colorant mentioned above can be used.

(Dissolution or Dispersion of Release Agent)

When a wax insoluble in the organic solvent is used as a release agent, the wax dispersion is prepared by typical methods. Namely, the mixture of the organic solvent and the wax is subjected to a dispersion treatment using a bead mill. In this case, it is preferable that the mixture is once heated to the melting point of the wax followed by cooling with an agitation, before being subjected to the dispersion treatment using a bead mill. This is because the dispersion time can be shortened. The waxes can be used alone or in combination, and optionally mixed with a dispersibility improving agent and another polyester resin.

(Aqueous Medium)

Suitable aqueous media include water. In addition, other solvents which can be mixed with water can be added to water. Specific examples of such solvents include alcohols (e.g., methanol, isopropanol, ethylene glycol), dimethylformamide, tetrahydrofuran, cellosolves (e.g., methyl cellosolve), lower ketones (e.g., acetone, methyl ethyl ketone), etc. The content of the aqueous medium to 100 parts by weight of the toner constituent mixture liquid is typically from 50 to 2,000 parts by weight, and preferably from 100 to 1,000 parts by weight. When the content is too small, the toner constituents tend not to be well dispersed, and thereby a toner having a desired particle diameter cannot be prepared. In contrast, when the content is too large, the production costs increase.

(Inorganic Dispersant and Particulate Organic Resin)

The aqueous medium optionally includes an inorganic dispersant or a particulate organic resin (P). When an inorganic dispersant or a particulate organic resin (P) is used, the resultant particles have a sharp particle diameter distribution and good dispersion stability. Specific examples of the inorganic dispersants include, but are not limited to, tricalcium phosphate, calcium carbonate, titanium oxide, colloidal silica, hydroxyapatite, etc. Any resins capable of forming an aqueous dispersion thereof can be used for the particulate organic resin (P), whether the resin is thermoplastic resin or thermosetting resin. Specific examples of resins used for the particulate organic resins (P) include, but are not limited to, vinyl resins, polyurethane resins, epoxy resins, polyester resins, polyamide resins, polyimide resins, silicon resins, phenol resins, melamine resins, urea resins, aniline resins, ionomer resins, polycarbonate resins, etc. These resins can be used alone or in combination. Among these resins, vinyl resins, polyurethane resins, epoxy resins, and polyester resins are preferably used because these resins can easily form aqueous dispersions of the particulate resins thereof.

The particulate organic resin (P) is added to the aqueous medium before granulating toner particles for the purpose of stabilizing emulsification. The particulate organic resin (P) partially adheres to the surfaces of the toner particles. As a result, the particulate organic resin (P) forms a part of the binder resin (R2) included in the outermost region (A).

In particular, the toner includes the particulate organic resin (P) in an amount of about 2% by weight. Therefore, even if all of the particulate organic resin (P) adheres to the surfaces of the toner particles, the particulate organic resin (P) occupies a small portion of the binder resin (R2).

(Methods for Dispersing Particulate Organic Resin (P) in Aqueous Medium)

Suitable methods for forming an aqueous dispersion of the particulate organic resin (P) are as follows, but are not limited thereto:

(a) When the resin is a vinyl resin, an aqueous dispersion of a particulate resin is directly formed by polymerization reaction (such as suspension polymerization, emulsion polymerization, seed polymerization, and dispersion polymerization) of monomers in an aqueous medium.

(b) When the resin is a polyaddition resin or a polycondensation resin such as polyester resin, polyurethane resin, and epoxy resin, a precursor of the resin (such as monomer and oligomer) or a solvent solution of the precursor is dispersed in an aqueous medium in the presence of a suitable dispersing agent, followed by heating or adding a curing agent so that an aqueous dispersion of a particulate resin is formed.

(c) When the resin is a polyaddition resin or a polycondensation resin such as polyester resin, polyurethane resin, and epoxy resin, a precursor of the resin (such as monomer and oligomer, preferably in liquid form, if not liquid, preferably liquefied by the application of heat) or a solvent solution of the precursor is phase-inversion emulsified by adding an aqueous medium after adding a suitable emulsifying agent thereto so that an aqueous dispersion of a particulate resin is formed.

(d) A resin formed by polymerization reaction (such as addition polymerization, ring-opening polymerization, condensation polymerization, and addition condensation) is pulverized using a mechanical rotational type pulverizer or a jet type pulverizer, followed by classification, to prepare a particulate resin. The particulate resin is dispersed in an aqueous medium in the presence of a suitable dispersing agent so that an aqueous dispersion of the particulate resin is formed.

(e) A resin formed by polymerization reaction (such as addition polymerization, ring-opening polymerization, condensation polymerization, and addition condensation) is dissolved in a solvent, and then the resin solution is sprayed in the air to prepare a particulate resin. The particulate resin is dispersed in an aqueous medium in the presence of a suitable dispersing agent so that an aqueous dispersion of the particulate resin is formed.

(f) A resin formed by polymerization reaction (such as addition polymerization, ring-opening polymerization, condensation polymerization, and addition condensation) is dissolved in a solvent to prepare a resin solution. Another solvent is added to the resin solution or the resin solution is subjected to cooling after heating, and then the solvent is removed so that a particulate resin separates out. The particulate resin is dispersed in an aqueous medium in the presence of a suitable dispersing agent so that an aqueous dispersion of the particulate resin is formed.

(g) A resin formed by polymerization reaction (such as addition polymerization, ring-opening polymerization, condensation polymerization, and addition condensation) is dissolved in a solvent, and then the resin solution is dispersed in an aqueous medium in the presence of a suitable dispersing agent, followed by removal of the solvent, so that an aqueous dispersion of a particulate resin is formed.

(h) A resin formed by polymerization reaction (such as addition polymerization, ring-opening polymerization, condensation polymerization, and addition condensation) is dissolved in a solvent, and then the resin solution is phase-inversion emulsified by adding an aqueous medium after adding a suitable emulsifying agent thereto so that an aqueous dispersion of a particulate resin is formed.

(Surfactant)

When the toner constituent mixture liquid is emulsified and dispersed in an aqueous medium, surfactants are preferably used.

Specific examples of the surfactants include, but are not limited to, anionic surfactants such as alkylbenzene sulfonic acid salts, α-olefin sulfonic acid salts and phosphoric acid salts; cationic surfactants such as amine salts (e.g., alkyl amine salts, aminoalcohol fatty acid derivatives, polyamine fatty acid derivatives, imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts, benzethonium chloride); nonionic surfactants such as fatty acid amine derivatives and polyhydric alcohol derivatives; and ampholytic surfactants such as aniline, dodecyldi(aminoethyl)glycin, di(octylaminoethyl)glycin, and N-alkyl-N,N-dimethylammonium betaine.

By using a fluorine-containing surfactant as the surfactant, good charging properties and good charge rising property can be imparted to the resultant toner. Specific examples of anionic surfactants having a fluoroalkyl group include, but are not limited to, fluoroalkyl carboxylic acids having from 2 to 10 carbon atoms and metal salts thereof, disodium perfluorooctanesulfonylglutamate, sodium 3-{ω-fluoroalkyl(C6-C11)oxy}-1-alkyl(C3-C4) sulfonate, sodium 3-{ω-fluoroalkanoyl (C6-C8)-N-ethylamino}-1-propanesulfonate, fluoroalkyl(C11-C20) carboxylic acids and metal salts thereof, perfluoroalkyl(C7-C13) carboxylic acids and metal salts thereof, perfluoroalkyl(C4-C12) sulfonate and metal salts thereof, perfluorooctanesulfonic acid diethanol amides, N-propyl-N-(2-hydroxyethyl)perfluorooctanesulfone amide, perfluoroalkyl(C6-C10)sulfoneamidepropyltrimethyl ammonium salts, salts of perfluoroalkyl(C6-C10)-N-ethylsulfonyl glycin, monoperfluoroalkyl(C6-C16)ethylphosphates, etc. Specific examples of the cationic surfactants having a fluoroalkyl group include, but are not limited to, primary, secondary, and tertiary aliphatic amines having a fluoroalkyl group, aliphatic quaternary salts such as perfluoroalkyl(C6-C10)sulfoneamidepropyltrimethylammonium salts, benzalkonium salts, benzetonium chloride, pyridinium salts, imidazolinium salts, etc.

(Polymeric Protection Colloid)

Further, it is possible to stably disperse the toner constituent mixture liquid in an aqueous liquid using a polymeric protection colloid. Specific examples of such protection colloids include, but are not limited to, polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid, maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, glycerinmonomethacrylic acid esters, N-methylolacrylamide, N-methylolmethacrylamide), vinyl alcohols and ethers thereof (e.g., vinyl methyl ether, vinyl ethyl ether, vinyl propyl ether), esters of vinyl alcohols with a compound having a carboxyl group (e.g., vinyl acetate, vinyl propionate, vinyl butyrate); acrylic amides (e.g., acrylamide, methacrylamide, diacetoneacrylamide) and methylol compounds thereof, acid chlorides (e.g., acrylic acid chloride, methacrylic acid chloride), and monomers having a nitrogen atom or an alicyclic ring having a nitrogen atom (e.g., vinyl pyridine, vinyl pyrrolidone, vinyl imidazole, ethylene imine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, polyoxyethylene nonylphenyl esters); and cellulose compounds such as methyl cellulose, hydroxyethyl cellulose and hydroxypropyl cellulose, can also be used as the polymeric protective colloid. When a dispersant such as calcium phosphate which can be dissolved in an acid or an alkali is used, the particles are preferably washed by a method in which the particles are washed with an acid such as hydrochloric acid to dissolve the dispersant, and then washed with water. In addition, such dispersants can also be removed from the resultant particles by a method using an enzyme. The dispersants can remain on the surface of the particles, however, it is preferable to be removed so that the resultant toner has a good chargeability.

(Dispersing Machine)

As the dispersing machine, known mixers and dispersing machines such as low shearing force type dispersing machines, high shearing force type dispersing machines, friction type dispersing machines, high pressure jet type dispersing machines, and ultrasonic dispersing machine can be used. In order to prepare a dispersion including particles having an average particle diameter of from 2 to 20 μm, high shearing force type dispersing machines are preferably used. When high shearing force type dispersing machines are used, the rotation speed of rotors is not particularly limited, but the rotation speed is generally from 1,000 to 30,000 rpm and preferably from 5,000 to 20,000 rpm. The temperature in the dispersing process is generally 0 to 150° C. (under pressure), and preferably from 20 to 80° C.

(Solvent Removal)

In order to remove the organic solvent from the thus prepared emulsion, any known removing methods can be used. For example, a method in which the emulsion is gradually heated under normal pressure or reduced pressure to perfectly evaporate the organic solvent in the drops of the oil phase can be used.

Adherence of Particulate Resin

Next, the process in which a particulate vinyl copolymer resin (R2) is adhered to core particles including a polyester resin (hereinafter referred to the adherence process) will be explained. The particulate vinyl copolymer resin (R2) (hereinafter referred to as particulate resin) is preferably used as an aqueous dispersion thereof. The aqueous dispersion of the particulate resin can be easily prepared by typical emulsion polymerization methods and the resultant dispersion can be used for the adherence process without any treatment. The aqueous dispersion of the particulate resin can optionally include a surfactant in order to stably disperse the core particles and the particulate resin. The aqueous dispersion of the particulate resin is preferably added to the dispersion of the core particles after the organic solvent is removed therefrom.

In the adherence process, the pH of the dispersion can be controlled by adding sodium hydride or hydrochloric acid, in order to efficiently adhere the particulate resin to the core particles.

As an aggregation agent, metal salts comprising metals having 1 to 3 valences can be used. Specific examples of the monovalent metals include, but are not limited to, lithium, potassium, sodium, etc. Specific examples of the divalent metals include, but are not limited to, calcium, magnesium, etc. Specific examples of the trivalent metals include, but are not limited to, aluminum, etc. Specific examples of anionic ions comprised in the salts include, but are not limited to, chloride ion, bromide ion, iodide ion, carbonate ion, sulfate ion, etc. The adherence can be accelerated by the application of heat. The heating temperature can be whether above or under the glass transition temperature (Tg) of the particulate resin. However, when the adherence process is performed at a temperature around or under Tg, there may be cases where the particulate resin does not well aggregate and/or fuse. Therefore, in this case, the adherence process may preferably be performed again at higher temperature in order to accelerate aggregation and fusion of the particle resin so that the particulate resin sufficiently cover the core particles and the surface of the shell is made uniform. However, the uniformity of the surface and the circularity of the toner particles are controlled by controlling the heating temperature and the heating time.

Elongation and/or Crosslinking Reaction

In order that the resultant toner may include the modified polyester resin (R14) having a urethane and/or a urea group, the polyester resin (R13) having an isocyanate group at its ends (i.e., prepolymer) is mixed with an amine capable of reacting with the prepolymer. In this case, the amine can be mixed with the prepolymer in the oil phase liquid before the toner constituent mixture is dispersed in an aqueous medium, or the amine can be directly added to the aqueous medium. The reaction time is determined depending on the reactivity of the isocyanate of the prepolymer used with the amine used. However, the reaction time is typically from 1 minutes to 40 hours, and preferably from 1 to 24 hours. The reaction temperature is typically from 0 to 150° C. and preferably from 20 to 98° C. The reaction can be performed before the adherence process, or with the adherence process simultaneously. Of course, the reaction can be performed after the adherence process. In addition, known catalysts can be added, if desired, when the reaction is performed.

Washing and Drying

The toner particles dispersed in an aqueous medium are washed and dried by any known methods. In particular, the toner particles and the aqueous medium are separated by a centrifugal separator or a filter press (i.e., solid-liquid separation) so that the toner cake is prepared. Then the toner cake is re-dispersed in ion-exchange water at a temperature of from room temperature to 40° C., followed by pH control using acids and bases, if desired. The solid-liquid separation is repeated several times to remove impurities and surfactants. After the washing treatment, the toner particles are subjected to a drying treatment using a flash dryer, a circulating dryer, a vacuum dryer, a vibrating fluid dryer, etc. The toner particles having a small particle diameter can be removed by a centrifugal separation in the liquid, or the toner particles can be subjected to a classification treatment using a known classifier after the drying treatment.

External Treatment

The thus prepared toner particles are then mixed with one or more other particulate materials such as charge controlling agents, fluidizers optionally upon application of mechanical impact thereto to fix the particulate materials on the toner particles. Specific examples of such mechanical impact application methods include methods in which a mixture is mixed with a highly rotated blade and methods in which a mixture is put into a jet air to collide the particles against each other or a collision plate. Specific examples of such mechanical impact applicators include, but are not limited to, ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTON SYSTEM (manufactured by Kawasaki Heavy Industries, Ltd.), automatic mortars, etc.

Image Forming Apparatus

The toner of the present invention can be used for any known image forming apparatuses for forming both monochrome images and full-color images.

The image forming apparatus may include an endless intermediate transfer device.

The image forming apparatus may include a cleaning device configured to remove toner particles remaining on the photoreceptor and/or the intermediate transfer device. The cleaning device may be formed of a blade, but is not limited thereto.

The fixing device of the image forming apparatus may include a heating device including a roller or a belt. The fixing device may be an oil-less fixing device.

Developer

The toner of the present invention can be used for both a one-component developer and a two-component developer. The toner is contained in a toner container when used for an image forming apparatus.

Process Cartridge

Figure 3:
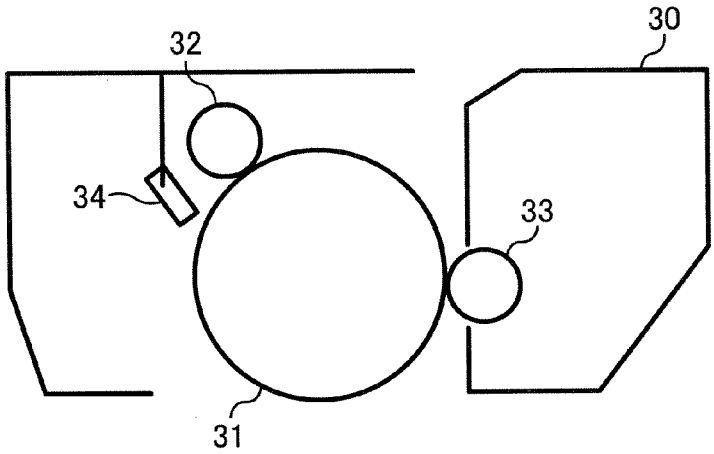
FIG. 3 is a schematic view illustrating an embodiment of a process cartridge using the toner of the present invention.

The toner of the present invention is used for an image forming apparatus including a process cartridge illustrated in FIG. 3. Such a process cartridge is detachably attached to an image forming apparatus such as copiers and printers.

The process cartridge 30 includes a photoreceptor 31, a charger 32, a developing device 33, and a cleaning device 34. The photoreceptor 31 rotates at a predetermined speed, and the surface thereof is charged by the charger 32 to reach to a positive or negative predetermined potential while rotating. The photoreceptor 31 is irradiated with a light containing image information emitted by a light irradiator such as a slit irradiator, a laser beam scanning irradiator, etc., to form an electrostatic latent image thereon. The electrostatic latent image is developed with a toner in the developing device 33, and then the toner image is transferred onto a transfer material which is timely fed from a feeding part to an area formed between the photoreceptor 31 and the transfer device so as to meet the toner images on the photoreceptor 31. The transfer material having the toner images thereon is separated from the photoreceptor 31 and transported to a fixing device so that the toner image is fixed and discharged from the image forming apparatus as a copying or a printing. After the toner image is transferred, any residual toner particles remaining on the photoreceptor can be removed using the cleaning device 34, and then the photoreceptor is discharged. The photoreceptor 31 is used repeatedly.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Polyester

Preparation of Polyester (P-1)

The following components are fed in a reaction vessel equipped with a condenser, a stirrer and a nitrogen inlet pipe.

| | |
|---|---|
| Ethylene oxide (2 mole) adduct of bisphenol A | 233 parts |
| Propylene oxide (3 mole) adduct of bisphenol A | 525 parts |
| Terephthalic acid | 206 parts |
| Adipic acid | 47 parts |
| Dibutyltin oxide | 2 parts |

The mixture is reacted for 8 hours at 230° C. under normal pressure. Then the reaction is further continued for 5 hours under a reduced pressure of from 10 to 15 mmHg. Further, 46 parts of trimellitic anhydride is fed to the vessel to be reacted with the reaction product for 2 hours at 180° C. Thus, a polyester (P-1) is prepared.

The polyester (P-1) has a number average molecular weight (Mn) of 2,600, a weight average molecular weight (Mw) of 6,900, a glass transition temperature (Tg) of 44° C., and an acid value of 26 mgKOH/g.

Preparation of Polyester (P-2)

The following components are fed in a reaction vessel equipped with a condenser, a stirrer and a nitrogen inlet pipe.

| | |
|---|---|
| Ethylene oxide (2 mole) adduct of bisphenol A | 180 parts |
| Propylene oxide (3 mole) adduct of bisphenol A | 595 parts |
| Terephthalic acid | 192 parts |
| Adipic acid | 50 parts |
| Dibutyltin oxide | 2 parts |

The mixture is reacted for 8 hours at 230° C. under normal pressure. Then the reaction is further continued for 5 hours under a reduced pressure of from 10 to 15 mmHg. Further, 63 parts of trimellitic anhydride is fed to the vessel to be reacted with the reaction product for 3 hours at 180° C. Thus, a polyester (P-2) is prepared.

The polyester (P-2) has a number average molecular weight (Mn) of 2,800, a weight average molecular weight (Mw) of 7,200, a glass transition temperature (Tg) of 44° C., and an acid value of 33 mgKOH/g.

Preparation of Polyester (P-3)

The following components are fed in a reaction vessel equipped with a condenser, a stirrer and a nitrogen inlet pipe.

| | |
|---|---|
| Ethylene oxide (2 mole) adduct of bisphenol A | 550 parts |
| Propylene oxide (2 mole) adduct of bisphenol A | 201 parts |
| Terephthalic acid | 215 parts |
| Adipic acid | 48 parts |
| Dibutyltin oxide | 2 parts |

The mixture is reacted for 8 hours at 230° C. under normal pressure. Then the reaction is further continued for 5 hours under a reduced pressure of from 10 to 15 mmHg. Further, 25 parts of trimellitic anhydride is fed to the vessel to be reacted with the reaction product for 2 hours at 180° C. Thus, a polyester (P-3) is prepared.

The polyester (P-3) has a number average molecular weight (Mn) of 2,300, a weight average molecular weight (Mw) of 5,800, a glass transition temperature (Tg) of 43° C., and an acid value of 12 mgKOH/g.

Preparation of Particulate Vinyl Copolymer Resin

Preparation of Particulate Vinyl Copolymer Resin (V-1)

In a reaction vessel equipped with a condenser, a stirrer and a nitrogen inlet pipe, 1.6 parts of sodium dodecyl sulfate and 492 parts of ion-exchange water are contained and the mixture is heated to 80° C. Then a mixture of 2.5 parts of potassium persulfate and 100 parts of ion-exchange water are added thereto. After 15-minutes left, a mixture of the following components is gradually added thereto over a period of 90 minutes.

| | |
|---|---|
| Styrene monomer | 153 parts |
| Butyl acrylate | 38 parts |
| Methacrylic acid | 9 parts |
| n-Octyl mercaptan | 3.5 parts |

The mixture is kept for 60 minutes at 80° C., and then cooled down. Thus, an aqueous dispersion of a particulate vinyl copolymer resin (V-1) is prepared.

The particulate vinyl copolymer resin (V-1) has an average particle diameter of 51 nm. A part of the dispersion is contained in a petri dish so that a dispersion medium (i.e., water) is removed and a solid material (i.e., particulate vinyl copolymer resin) can be obtained. The particulate vinyl copolymer resin (V-1) has a number average molecular weight (Mn) of 11,000, a weight average molecular weight (Mw) of 19,000, and a glass transition temperature (Tg) of 63° C.

Preparation of Particulate Vinyl Copolymer Resin (V-2)

In a reaction vessel equipped with a condenser, a stirrer and a nitrogen inlet pipe, 1.2 parts of sodium dodecyl sulfate and 492 parts of ion-exchange water are contained and the mixture is heated to 80° C. Then a mixture of 2.5 parts of potassium persulfate and 100 parts of ion-exchange water are added thereto. After 15-minutes left, a mixture of the following components is gradually added thereto over a period of 90 minutes.

| | |
|---|---|
| Styrene monomer | 148 parts |
| Butyl acrylate | 33 parts |
| Methacrylic acid | 19 parts |
| n-Octyl mercaptan | 3 parts |

The mixture is kept for 60 minutes at 80° C., and then cooled down. Thus, an aqueous dispersion of a particulate vinyl copolymer resin (V-2) is prepared.

The particulate vinyl copolymer resin (V-2) has an average particle diameter of 80 nm. A part of the dispersion is contained in a petri dish so that a dispersion medium (i.e., water) is removed and a solid material (i.e., particulate vinyl copolymer resin) can be obtained. The particulate vinyl copolymer resin (V-2) has a number average molecular weight (Mn) of 14,000, a weight average molecular weight (Mw) of 28,000, and a glass transition temperature (Tg) of 68° C.

Preparation of Particulate Vinyl Copolymer Resin (V-3)

In a reaction vessel equipped with a condenser, a stirrer and a nitrogen inlet pipe, 1.2 parts of sodium dodecyl sulfate and 492 parts of ion-exchange water are contained and the mixture is heated to 80° C. Then a mixture of 2.5 parts of potassium persulfate and 100 parts of ion-exchange water are added thereto. After 15-minutes left, a mixture of the following components is gradually added thereto over a period of 90 minutes.

| | |
|---|---|
| Styrene monomer | 156 parts |
| Butyl acrylate | 29 parts |
| Methacrylic acid | 15 parts |
| n-Octyl mercaptan | 3.4 parts |

The mixture is kept for 60 minutes at 80° C., and then cooled down. Thus, an aqueous dispersion of a particulate vinyl copolymer resin (V-3) is prepared.

The particulate vinyl copolymer resin (V-3) has an average particle diameter of 88 nm. A part of the dispersion is contained in a petri dish so that a dispersion medium (i.e., water) is removed and a solid material (i.e., particulate vinyl copolymer resin) can be obtained. The particulate vinyl copolymer resin (V-3) has a number average molecular weight (Mn) of 12,000, a weight average molecular weight (Mw) of 23,000, and a glass transition temperature (Tg) of 68° C.

Preparation of Prepolymer

The following components are fed in a reaction vessel equipped with a condenser, a stirrer and a nitrogen inlet pipe.

| | |
|---|---|
| Ethylene oxide (2 mole) adduct of bisphenol A | 682 parts |
| Propylene oxide (2 mole) adduct of bisphenol A | 81 parts |
| Terephthalic acid | 283 parts |
| Trimellitic anhydride | 22 parts |
| Dibutyl tin oxide | 2 parts |

The mixture is reacted for 8 hours at 230° C. under normal pressure. Then the reaction is further continued for 5 hours under a reduced pressure of from 10 to 15 mmHg. Thus, an intermediate polyester resin (1) is prepared. The intermediate polyester (1) has a number average molecular weight (Mn) of 2,100, a weight average molecular weight (Mw) of 9,500, a glass transition temperature (Tg) of 55° C., an acid value of 0.5 mgKOH/g, and a hydroxyl value of 49 mgKOH/g.

In a reaction vessel equipped with a condenser, a stirrer and a nitrogen inlet pipe, 411 parts of the intermediate polyester resin (1), 89 parts of isophorone diisocyanate, 300 parts of ethyl acetate, and 200 parts of methyl ethyl ketone are mixed and the mixture is heated at 100° C. for 5 hours to perform the reaction. Thus, a polyester prepolymer (1) having an isocyanate group is prepared. A ratio of free isocyanate group included in the polyester prepolymer (1) is 1.53% by weight.

Preparation of Master Batch

Preparation of Master Batch (1)

The following components are mixed using a HENSCHEL MIXER.

| | |
|---|---|
| Carbon black (REGAL 400R from Cabot Corp.) | 40 parts |
| Polyester resin (RS-801 from Sanyo Chemical Industries Ltd., having an acid value of 10 mgKOH/g, Mw of 20,000, and Tg of 64° C.) | 60 parts |
| Water | 30 parts |

The mixture is kneaded with a two-roll mill for 45 minutes at 130° C., and then pulverized into particles having a particle diameter of 1 mm using a pulverizer. Thus, a master batch (1) is prepared.

Preparation of Master Batch (2)

The following components are mixed using a HENSCHEL MIXER.

| | |
|---|---|
| C.I. Pigment Blue 15:3 (ECB-301 from Dainichiseika Color & Chemicals Mfg. Co., Ltd.) | 50 parts |
| Polyester resin (RS-801 from Sanyo Chemical Industries Ltd., having an acid value of 10 mgKOH/g, Mw of 20,000, and Tg of 64° C.) | 50 parts |
| Pigment dispersing agent (SOLSPERSE S24000sc from Avecia Limited) | 15 parts |
| Pigment dispersing auxiliary agent (SOLSPERSE S5000 from Avecia Limited) | 2.5 parts |
| Water | 30 parts |

The mixture is kneaded with a two-roll mill for 45 minutes at 130° C., and then pulverized into particles having a particle diameter of 1 mm using a pulverizer. Thus, a master batch (2) is prepared.

Example 1

Preparation of Colorant/Wax Dispersion

In a reaction vessel equipped with a stirrer and a thermometer, 545 parts of the polyester (P-1), 181 parts of a wax (A), and 1450 parts of an ethyl acetate/methyl ethyl ketone mixture (40/60 by volume) are mixed and the mixture is heated to 80° C. while agitated. After being heated at 80° C. for 5 hours, the mixture is cooled to 30° C. over a period of 1 hour. Then 500 parts of the master batch (1) and 100 parts of the ethyl acetate/methyl ethyl ketone mixture (40/60 by volume) are added to the vessel, and the mixture is agitated for 1 hour to prepare a raw material mixture liquid (1).

Then 1500 parts of the raw material mixture liquid (1) are subjected to a dispersion treatment using a bead mill (ULTRAVISCOMILL (trademark) from Aimex Co., Ltd.). The dispersing conditions are as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Then 425 parts of the polyester (P-1) and 230 parts of the ethyl acetate/methyl ethyl ketone mixture (40/60 by volume) are added thereto. The mixture is subjected to a dispersion treatment using the bead mill. The dispersion conditions are the same as those mentioned above except that the dispersion operation is performed once (i.e., one pass).

Thus, a colorant/wax dispersion (1) is prepared. Some of the ethyl acetate/methyl ethyl ketone mixture (40/60 by volume) is added to the colorant/wax dispersion (1) so that a solid content of the colorant/wax dispersion (1) is 50% at 130° C.

Preparation of Water Phase 970 parts of ion-exchange water, 40 parts of a 25% by weight of aqueous solution of a particulate resin (a copolymer of styrene-methacrylic acid-butyl acrylate-sodium salt of a sulfuric acid ester of ethylene oxide adduct of methacrylic acid) serving as a dispersion stabilizer, 140 parts of a 48.5% by weight of aqueous solution of a sodium salt of dodecyldiphenyl ether disulfonic acid (ELEMINOL MON-7 from Sanyo Chemical Industries Ltd.), and 90 parts of the ethyl acetate/methyl ethyl ketone mixture (40/60 by volume) are mixed. As a result, a milky liquid is prepared. Thus, a water phase (1) is prepared.

Emulsification

Then the following components are mixed in a vessel.

| | |
|---|---|
| Colorant/wax dispersion (1) | 975 parts |
| Isophorone diamine | 2.6 parts |

The components are mixed for 1 minute using a mixer TK HOMOMIXER (from Tokushu Kika Kogyo K.K.) at a revolution of 5,000 rpm. Then 88 parts of the prepolymer (1) is added thereto and mixed for 1 minute using a mixer TK HOMOMIXER (from Tokushu Kika Kogyo K.K.) at a revolution of 5,000 rpm.

Then 1200 parts of the water phase (1) is added thereto. The mixture is agitated for 20 minutes with a mixer TK HOMOMIXER (from Tokushu Kika Kogyo K.K.) at a revolution of from 8,000 to 13,000 rpm. Thus, an emulsion (1) is prepared.

Solvent Removal

The emulsion (1) is fed into a container equipped with a stirrer and a thermometer, and the emulsion is heated for 8 hours at 30° C. to remove the organic solvent therefrom. Thus, a dispersion (1) is prepared.

Adherence of Particulate Resin

The dispersion (1) and the dispersion of the particulate vinyl copolymer resin (V-1) are mixed at a mixing ratio of 1/0.3 based on a solid content. The mixture is heated to 74° C. over a period of 30 minutes. A mixture liquid of 100 parts of ion-exchange water and 100 parts of magnesium chloride hexahydrate is gradually added thereto and kept for 4 hours at 74° C. Then the mixture is controlled to have a pH of 5 by adding an aqueous solution of hydrochloric acid. The mixture is heated to 80° C. for 2 hours, and then cooled down. Thus, a dispersion (1-2) is prepared.

Washing and Drying

One hundred (100) parts of the dispersion (1-2) is filtered under a reduced pressure.

The thus obtained wet cake is mixed with 100 parts of ion-exchange water and the mixture is agitated for 10 minutes with a TK HOMOMIXER at a revolution of 12,000 rpm, followed by filtering. Thus, a wet cake (1) is prepared.

The wet cake (1) is mixed with 900 parts of ion-exchange water and the mixture is agitated for 30 minutes with a TK HOMOMIXER at a revolution of 12,000 rpm under application of an ultrasonic wave, followed by filtering under a reduced pressure. This washing operation is repeated until the mixture (i.e., re-slurry liquid) has an electric conductivity of not greater than 10 μC/cm. Thus, a wet cake (2) is prepared.

A re-slurry liquid of the wet cake (2) is mixed with a 10% aqueous solution of hydrochloric acid so that the re-slurry liquid has a pH of 4. The re-slurry liquid is agitated for 30 minutes with a stirrer, followed by filtering. Thus, a wet cake (3) is prepared.

The wet cake (3) is mixed with 100 parts of ion-exchange water and the mixture is agitated for 10 minutes with a TK HOMOMIXER at a revolution of 12,000 rpm, followed by filtering. This washing operation is repeated until the mixture (i.e., re-slurry liquid) has an electric conductivity of not greater than 10 μC/cm. Thus, a wet cake (4) is prepared.

The wet cake (4) is dried for 48 hours at 42° C. using a circulating air drier, followed by sieving with a screen having openings of 75 μm. Thus, mother toner particles (1) are prepared. The mother toner particles (1) have a volume average particle diameter (Dv) of 5.9 μm, a number average particle diameter (Dp) of 5.3 μm, a particle diameter distribution Dv/Dp of 1.11, and an average circularity of 0.976.

Then 100 parts of the mother toner particles (1) are mixed with 0.5 parts of a hydrophobized silica and 0.5 parts of a hydrophobized titanium oxide using a HENSCHEL MIXER. Thus, a toner (1) is prepared.

Example 2

Preparation of Colorant/Wax Dispersion

In a reaction vessel equipped with a stirrer and a thermometer, 580 parts of the polyester (P-1), 130 parts of a wax (B), and 1400 parts of an ethyl acetate/methyl ethyl ketone mixture (40/60 by volume) are mixed and the mixture is heated to 80° C. while agitated. After being heated at 80° C. for 5 hours, the mixture is cooled to 30° C. over a period of 1 hour. Then 500 parts of the master batch (1) and 100 parts of the ethyl acetate/methyl ethyl ketone mixture (40/60 by volume) are added to the vessel, and the mixture is agitated for 1 hour to prepare a raw material mixture liquid (2).

Then 1500 parts of the raw material mixture liquid (2) are subjected to a dispersion treatment under the same condition as Example 1.

Then 425 parts of the polyester (P-1) and 230 parts of the ethyl acetate/methyl ethyl ketone mixture (40/60 by volume) are added thereto. The mixture is subjected to a dispersion treatment using the bead mill. The dispersion conditions are the same as those mentioned above except that the dispersion operation is performed once (i.e., one pass).

Thus, a colorant/wax dispersion (2) is prepared. Some of the ethyl acetate/methyl ethyl ketone mixture (40/60 by volume) is added to the colorant/wax dispersion (2) so that a solid content of the colorant/wax dispersion (2) is 50% at 130° C.

Emulsification

Then the following components are mixed in a vessel.

| | |
|---|---|
| Colorant/wax dispersion (2) | 975 parts |
| Isophorone diamine | 2.6 parts |

The components are mixed for 1 minute using a mixer TK HOMOMIXER (from Tokushu Kika Kogyo K.K.) at a revolution of 5,000 rpm. Then 88 parts of the prepolymer (1) is added thereto and mixed for 1 minute using a mixer TK HOMOMIXER (from Tokushu Kika Kogyo K.K.) at a revolution of 5,000 rpm.

Then 1200 parts of the water phase (1) is added thereto. The mixture is agitated for 20 minutes with a mixer TK HOMOMIXER (from Tokushu Kika Kogyo K.K.) at a revolution of from 8,000 to 13,000 rpm. Thus, an emulsion (2) is prepared.

Solvent Removal

The emulsion (2) is fed into a container equipped with a stirrer and a thermometer, and the emulsion is heated for 8 hours at 30° C. to remove the organic solvent therefrom. Thus, a dispersion (2) is prepared.

Adherence of Particulate Resin

The dispersion (2) and the dispersion of the particulate vinyl copolymer resin (V-3) are mixed at a mixing ratio of 1/0.15 based on a solid content. The mixture is heated to 74° C. over a period of 30 minutes. A mixture liquid of 100 parts of ion-exchange water and 100 parts of magnesium chloride hexahydrate is gradually added thereto and kept for 3 hours at 74° C. Then the mixture is controlled to have a pH of 5 by adding an aqueous solution of hydrochloric acid. The mixture is heated to 80° C. for 2 hours, and then cooled down. Thus, a dispersion (2-2) is prepared.

The procedure for preparation of the toner (1) in Example 1 is repeated except the dispersion (1-2) is replaced with the dispersion (2-2). Thus, a toner (2) is prepared.

Example 3

Preparation of Colorant/Wax Dispersion

In a reaction vessel equipped with a stirrer and a thermometer, 516 parts of the polyester (P-2), 100 parts of a wax (A), and 1300 parts of an ethyl acetate/methyl ethyl ketone mixture (40/60 by volume) are mixed and the mixture is heated to 80° C. while agitated. After being heated at 80° C. for 5 hours, the mixture is cooled to 30° C. over a period of 1 hour. Then 500 parts of the master batch (1) and 100 parts of the ethyl acetate/methyl ethyl ketone mixture (40/60 by volume) are added to the vessel, and the mixture is agitated for 1 hour to prepare a raw material mixture liquid (3).

Then 1500 parts of the raw material mixture liquid (3) are subjected to a dispersion treatment under the same condition as Example 1.

Then 425 parts of the polyester (P-2) and 230 parts of the ethyl acetate/methyl ethyl ketone mixture (40/60 by volume) are added thereto. The mixture is subjected to a dispersion treatment using the bead mill. The dispersion conditions are the same as those mentioned above except that the dispersion operation is performed once (i.e., one pass).

Thus, a colorant/wax dispersion (3) is prepared. Some of the ethyl acetate/methyl ethyl ketone mixture (40/60 by volume) is added to the colorant/wax dispersion (3) so that a solid content of the colorant/wax dispersion (3) is 50% at 130° C.

Emulsification

Then the following components are mixed in a vessel.

| | |
|---|---|
| Colorant/wax dispersion (3) | 975 parts |
| Isophorone diamine | 2.6 parts |

The components are mixed for 1 minute using a mixer TK HOMOMIXER (from Tokushu Kika Kogyo K.K.) at a revolution of 5,000 rpm. Then 88 parts of the prepolymer (1) is added thereto and mixed for 1 minute using a mixer TK HOMOMIXER (from Tokushu Kika Kogyo K.K.) at a revolution of 5,000 rpm.

Then 1200 parts of the water phase (1) is added thereto. The mixture is agitated for 20 minutes with a mixer TK HOMOMIXER (from Tokushu Kika Kogyo K.K.) at a revolution of from 8,000 to 13,000 rpm. Thus, an emulsion (3) is prepared.

Solvent Removal

The emulsion (3) is fed into a container equipped with a stirrer and a thermometer, and the emulsion is heated for 8 hours at 30° C. to remove the organic solvent therefrom. Thus, a dispersion (3) is prepared.

Adherence of Particulate Resin

The dispersion (3) and the dispersion of the particulate vinyl copolymer resin (V-3) are mixed at a mixing ratio of 1/0.2 based on a solid content. The mixture is heated to 74° C. over a period of 30 minutes. A mixture liquid of 100 parts of ion-exchange water and 100 parts of magnesium chloride hexahydrate is gradually added thereto and kept for 4 hours at 74° C. Then the mixture is controlled to have a pH of 5 by adding an aqueous solution of hydrochloric acid. The mixture is heated to 80° C. for 2 hours, and then cooled down. Thus, a dispersion (3-2) is prepared.

The procedure for preparation of the toner (1) in Example 1 is repeated except the dispersion (1-2) is replaced with the dispersion (3-2). Thus, a toner (3) is prepared.

Example 4

Preparation of Colorant/Wax Dispersion

In a reaction vessel equipped with a stirrer and a thermometer, 516 parts of the polyester (P-2), 276 parts of a wax (A), and 1300 parts of an ethyl acetate/methyl ethyl ketone mixture (40/60 by volume) are mixed and the mixture is heated to 80° C. while agitated. After being heated at 80° C. for 5 hours, the mixture is cooled to 30° C. over a period of 1 hour. Then 500 parts of the master batch (2) and 100 parts of the ethyl acetate/methyl ethyl ketone mixture (40/60 by volume) are added to the vessel, and the mixture is agitated for 1 hour to prepare a raw material mixture liquid (4).

Then 1500 parts of the raw material mixture liquid (4) are subjected to a dispersion treatment under the same condition as Example 1.

Then 375 parts of the polyester (P-2) and 230 parts of the ethyl acetate/methyl ethyl ketone mixture (40/60 by volume) are added thereto. The mixture is subjected to a dispersion treatment using the bead mill. The dispersion conditions are the same as those mentioned above except that the dispersion operation is performed once (i.e., one pass).

Thus, a colorant/wax dispersion (4) is prepared. Some of the ethyl acetate/methyl ethyl ketone mixture (40/60 by volume) is added to the colorant/wax dispersion (4) so that a solid content of the colorant/wax dispersion (4) is 50% at 130° C.

Emulsification

Then 975 parts of the colorant/wax dispersion (4) is added to 1200 parts of the water phase (1). The mixture is agitated for 20 minutes with a mixer TK HOMOMIXER (from Tokushu Kika Kogyo K.K.) at a revolution of from 8,000 to 13,000 rpm. Thus, an emulsion (4) is prepared.

Solvent Removal

The emulsion (4) is fed into a container equipped with a stirrer and a thermometer, and the emulsion is heated for 8 hours at 30° C. to remove the organic solvent therefrom. Thus, a dispersion (4) is prepared.

Adherence of Particulate Resin

The dispersion (4) and the dispersion of the particulate vinyl copolymer resin (V-2) are mixed at a mixing ratio of 1/0.4 based on a solid content. The mixture is heated to 74° C. over a period of 30 minutes. A mixture liquid of 100 parts of ion-exchange water and 100 parts of magnesium chloride hexahydrate is gradually added thereto and kept for 6 hours at 74° C. Then the mixture is controlled to have a pH of 5 by adding an aqueous solution of hydrochloric acid. The mixture is heated to 80° C. for 2 hours, and then cooled down. Thus, a dispersion (4-2) is prepared.

The procedure for preparation of the toner (1) in Example 1 is repeated except the dispersion (1-2) is replaced with the dispersion (4-2). Thus, a toner (4) is prepared.

Example 5

Preparation of Colorant/Wax Dispersion

In a reaction vessel equipped with a stirrer and a thermometer, 540 parts of the polyester (P-1), 70 parts of a wax (B), and 1300 parts of an ethyl acetate/methyl ethyl ketone mixture (40/60 by volume) are mixed and the mixture is heated to 80° C. while agitated. After being heated at 80° C. for 5 hours, the mixture is cooled to 30° C. over a period of 1 hour. Then 500 parts of the master batch (1) and 100 parts of the ethyl acetate/methyl ethyl ketone mixture (40/60 by volume) are added to the vessel, and the mixture is agitated for 1 hour to prepare a raw material mixture liquid (5).

Then 1500 parts of the raw material mixture liquid (5) are subjected to a dispersion treatment under the same condition as Example 1.

Then 425 parts of the polyester (P-1) and 230 parts of the ethyl acetate/methyl ethyl ketone mixture (40/60 by volume) are added thereto. The mixture is subjected to a dispersion treatment using the bead mill. The dispersion conditions are the same as those mentioned above except that the dispersion operation is performed once (i.e., one pass).

Thus, a colorant/wax dispersion (5) is prepared. Some of the ethyl acetate/methyl ethyl ketone mixture (40/60 by volume) is added to the colorant/wax dispersion (5) so that a solid content of the colorant/wax dispersion (5) is 50% at 130° C.

Emulsification

Then the following components are mixed in a vessel.

| | |
|---|---|
| Colorant/wax dispersion (5) | 975 parts |
| Isophorone diamine | 2.6 parts |

The components are mixed for 1 minute using a mixer TK HOMOMIXER (from Tokushu Kika Kogyo K.K.) at a revolution of 5,000 rpm. Then 90 parts of the prepolymer (1) is added thereto and mixed for 1 minute using a mixer TK HOMOMIXER (from Tokushu Kika Kogyo K.K.) at a revolution of 5,000 rpm.

Then 1200 parts of the water phase (1) is added thereto. The mixture is agitated for 20 minutes with a mixer TK HOMOMIXER (from Tokushu Kika Kogyo K.K.) at a revolution of from 8,000 to 13,000 rpm. Thus, an emulsion (5) is prepared.

Solvent Removal

The emulsion (5) is fed into a container equipped with a stirrer and a thermometer, and the emulsion is heated for 8 hours at 30° C. to remove the organic solvent therefrom. Thus, a dispersion (5) is prepared.

Adherence of Particulate Resin

The dispersion (5) and the dispersion of the particulate vinyl copolymer resin (V-3) are mixed at a mixing ratio of 1/0.15 based on a solid content. The mixture is heated to 74° C. over a period of 30 minutes. A mixture liquid of 100 parts of ion-exchange water and 100 parts of magnesium chloride hexahydrate is gradually added thereto and kept for 3 hours at 74° C. Then the mixture is controlled to have a pH of 5 by adding an aqueous solution of hydrochloric acid. The mixture is heated to 80° C. for 2 hours, and then cooled down. Thus, a dispersion (5-2) is prepared.

The procedure for preparation of the toner (1) in Example 1 is repeated except the dispersion (1-2) is replaced with the dispersion (5-2). Thus, a toner (5) is prepared.

Example 6

Preparation of Colorant/Wax Dispersion

In a reaction vessel equipped with a stirrer and a thermometer, 600 parts of the polyester (P-1), 85 parts of a wax (C), and 1400 parts of an ethyl acetate/methyl ethyl ketone mixture (40/60 by volume) are mixed and the mixture is heated to 80° C. while agitated. After being heated at 80° C. for 5 hours, the mixture is cooled to 30° C. over a period of 1 hour. Then 500 parts of the master batch (1) and 100 parts of the ethyl acetate/methyl ethyl ketone mixture (40/60 by volume) are added to the vessel, and the mixture is agitated for 1 hour to prepare a raw material mixture liquid (6).

Then 1500 parts of the raw material mixture liquid (6) are subjected to a dispersion treatment under the same condition as Example 1.

Then 425 parts of the polyester (P-1) and 230 parts of the ethyl acetate/methyl ethyl ketone mixture (40/60 by volume) are added thereto. The mixture is subjected to a dispersion treatment using the bead mill. The dispersion conditions are the same as those mentioned above except that the dispersion operation is performed once (i.e., one pass).

Thus, a colorant/wax dispersion (6) is prepared. Some of the ethyl acetate/methyl ethyl ketone mixture (40/60 by volume) is added to the colorant/wax dispersion (6) so that a solid content of the colorant/wax dispersion (6) is 50% at 130° C.

Emulsification

Then the following components are mixed in a vessel.

| | |
|---|---|
| Colorant/wax dispersion (6) | 975 parts |
| Isophorone diamine | 2.6 parts |

The components are mixed for 1 minute using a mixer TK HOMOMIXER (from Tokushu Kika Kogyo K.K.) at a revolution of 5,000 rpm. Then 88 parts of the prepolymer (1) is added thereto and mixed for 1 minute using a mixer TK HOMOMIXER (from Tokushu Kika Kogyo K.K.) at a revolution of 5,000 rpm.

Then 1200 parts of the water phase (1) is added thereto. The mixture is agitated for 20 minutes with a mixer TK HOMOMIXER (from Tokushu Kika Kogyo K.K.) at a revolution of from 8,000 to 13,000 rpm. Thus, an emulsion (6) is prepared.

Solvent Removal

The emulsion (6) is fed into a container equipped with a stirrer and a thermometer, and the emulsion is heated for 8 hours at 30° C. to remove the organic solvent therefrom. Thus, a dispersion (6) is prepared.

Adherence of Particulate Resin

The dispersion (6) and the dispersion of the particulate vinyl copolymer resin (V-1) are mixed at a mixing ratio of 1/0.2 based on a solid content. The mixture is heated to 74° C. over a period of 30 minutes. A mixture liquid of 100 parts of ion-exchange water and 100 parts of magnesium chloride hexahydrate is gradually added thereto and kept for 3 hours at 74° C. Then the mixture is controlled to have a pH of 5 by adding an aqueous solution of hydrochloric acid. The mixture is heated to 80° C. for 2 hours, and then cooled down. Thus, a dispersion (6-2) is prepared.

The procedure for preparation of the toner (1) in Example 1 is repeated except the dispersion (1-2) is replaced with the dispersion (6-2). Thus, a toner (6) is prepared.

Comparative Example 1

Preparation of Colorant/Wax Dispersion

In a reaction vessel equipped with a stirrer and a thermometer, 545 parts of the polyester (P-3), 128 parts of a wax (E), and 1450 parts of an ethyl acetate/methyl ethyl ketone mixture (40/60 by volume) are mixed and the mixture is heated to 80° C. while agitated. After being heated at 80° C. for 5 hours, the mixture is cooled to 30° C. over a period of 1 hour. Then 500 parts of the master batch (1) and 100 parts of the ethyl acetate/methyl ethyl ketone mixture (40/60 by volume) are added to the vessel, and the mixture is agitated for 1 hour to prepare a raw material mixture liquid (7).

Then 1500 parts of the raw material mixture liquid (7) are subjected to a dispersion treatment under the same condition as Example 1.

Then 425 parts of the polyester (P-3) and 230 parts of the ethyl acetate/methyl ethyl ketone mixture (40/60 by volume) are added thereto. The mixture is subjected to a dispersion treatment using the bead mill. The dispersion conditions are the same as those mentioned above except that the dispersion operation is performed once (i.e., one pass).

Thus, a colorant/wax dispersion (7) is prepared. Some of the ethyl acetate/methyl ethyl ketone mixture (40/60 by volume) is added to the colorant/wax dispersion (7) so that a solid content of the colorant/wax dispersion (7) is 50% at 130° C.

Emulsification

Then the following components are mixed in a vessel.

| | |
|---|---|
| Colorant/wax dispersion (7) | 975 parts |
| Isophorone diamine | 2.6 parts |

The components are mixed for 1 minute using a mixer TK HOMOMIXER (from Tokushu Kika Kogyo K.K.) at a revolution of 5,000 rpm. Then 88 parts of the prepolymer (1) is added thereto and mixed for 1 minute using a mixer TK HOMOMIXER (from Tokushu Kika Kogyo K.K.) at a revolution of 5,000 rpm.

Then 1200 parts of the water phase (1) is added thereto. The mixture is agitated for 20 minutes with a mixer TK HOMOMIXER (from Tokushu Kika Kogyo K.K.) at a revolution of from 8,000 to 13,000 rpm. Thus, an emulsion (7) is prepared.

Solvent Removal

The emulsion (7) is fed into a container equipped with a stirrer and a thermometer, and the emulsion is heated for 8 hours at 30° C. to remove the organic solvent therefrom. Thus, a dispersion (7) is prepared.

Adherence of Particulate Resin

The dispersion (7) and the dispersion of the particulate vinyl copolymer resin (V-1) are mixed at a mixing ratio of 1/0.2 based on a solid content. The mixture is heated to 74° C. over a period of 30 minutes. A mixture liquid of 100 parts of ion-exchange water and 100 parts of magnesium chloride hexahydrate is gradually added thereto and kept for 4 hours at 74° C. Then the mixture is controlled to have a pH of 5 by adding an aqueous solution of hydrochloric acid. The mixture is heated to 80° C. for 2 hours, and then cooled down. Thus, a dispersion (7-2) is prepared.

The procedure for preparation of the toner (1) in Example 1 is repeated except the dispersion (1-2) is replaced with the dispersion (7-2). Thus, a toner (7) is prepared.

Comparative Example 2

Preparation of Colorant/Wax Dispersion

In a reaction vessel equipped with a stirrer and a thermometer, 460 parts of the polyester (P-1), 505 parts of a wax (D), and 1600 parts of an ethyl acetate/methyl ethyl ketone mixture (40/60 by volume) are mixed and the mixture is heated to 80° C. while agitated. After being heated at 80° C. for 5 hours, the mixture is cooled to 30° C. over a period of 1 hour. Then 500 parts of the master batch (1) and 100 parts of the ethyl acetate/methyl ethyl ketone mixture (40/60 by volume) are added to the vessel, and the mixture is agitated for 1 hour to prepare a raw material mixture liquid (8).

Then 1500 parts of the raw material mixture liquid (8) are subjected to a dispersion treatment under the same condition as Example 1.

Then 390 parts of the polyester (P-1) and 230 parts of the ethyl acetate/methyl ethyl ketone mixture (40/60 by volume) are added thereto. The mixture is subjected to a dispersion treatment using the bead mill. The dispersion conditions are the same as those mentioned above except that the dispersion operation is performed once (i.e., one pass).

Thus, a colorant/wax dispersion (8) is prepared. Some of the ethyl acetate/methyl ethyl ketone mixture (40/60 by volume) is added to the colorant/wax dispersion (8) so that a solid content of the colorant/wax dispersion (8) is 50% at 130° C.

Emulsification

Then 975 parts of the colorant/wax dispersion (8) is added to 1200 parts of the water phase (1). The mixture is agitated for 20 minutes with a mixer TK HOMOMIXER (from Tokushu Kika Kogyo K.K.) at a revolution of from 8,000 to 13,000 rpm. Thus, an emulsion (8) is prepared.

Solvent Removal

The emulsion (8) is fed into a container equipped with a stirrer and a thermometer, and the emulsion is heated for 8 hours at 30° C. to remove the organic solvent therefrom. Thus, a dispersion (8) is prepared.

Adherence of Particulate Resin

The dispersion (8) and the dispersion of the particulate vinyl copolymer resin (V-2) are mixed at a mixing ratio of 1/0.35 based on a solid content. The mixture is heated to 74° C. over a period of 30 minutes. A mixture liquid of 100 parts of ion-exchange water and 100 parts of magnesium chloride hexahydrate is gradually added thereto and kept for 6 hours at 74° C. Then the mixture is controlled to have a pH of 5 by adding an aqueous solution of hydrochloric acid. The mixture is heated to 80° C. for 2 hours, and then cooled down. Thus, a dispersion (8-2) is prepared.

The procedure for preparation of the toner (1) in Example 1 is repeated except the dispersion (1-2) is replaced with the dispersion (8-2). Thus, a toner (8) is prepared.

Comparative Example 3

Preparation of Colorant/Wax Dispersion

In a reaction vessel equipped with a stirrer and a thermometer, 560 parts of the polyester (P-3), 40 parts of a wax (A), and 1280 parts of an ethyl acetate/methyl ethyl ketone mixture (40/60 by volume) are mixed and the mixture is heated to 80° C. while agitated. After being heated at 80° C. for 5 hours, the mixture is cooled to 30° C. over a period of 1 hour. Then 500 parts of the master batch (1) and 100 parts of the ethyl acetate/methyl ethyl ketone mixture (40/60 by volume) are added to the vessel, and the mixture is agitated for 1 hour to prepare a raw material mixture liquid (9).

Then 1500 parts of the raw material mixture liquid (9) are subjected to a dispersion treatment under the same condition as Example 1.

Then 425 parts of the polyester (P-3) and 230 parts of the ethyl acetate/methyl ethyl ketone mixture (40/60 by volume) are added thereto. The mixture is subjected to a dispersion treatment using the bead mill. The dispersion conditions are the same as those mentioned above except that the dispersion operation is performed once (i.e., one pass).

Thus, a colorant/wax dispersion (9) is prepared. Some of the ethyl acetate/methyl ethyl ketone mixture (40/60 by volume) is added to the colorant/wax dispersion (9) so that a solid content of the colorant/wax dispersion (9) is 50% at 130° C.

Emulsification

Then the following components are mixed in a vessel.

| | |
|---|---|
| Colorant/wax dispersion (9) | 975 parts |
| Isophorone diamine | 2.6 parts |

The components are mixed for 1 minute using a mixer TK HOMOMIXER (from Tokushu Kika Kogyo K.K.) at a revolution of 5,000 rpm. Then 88 parts of the prepolymer (1) is added thereto and mixed for 1 minute using a mixer TK HOMOMIXER (from Tokushu Kika Kogyo K.K.) at a revolution of 5,000 rpm.

Then 1200 parts of the water phase (1) is added thereto. The mixture is agitated for 20 minutes with a mixer TK HOMOMIXER (from Tokushu Kika Kogyo K.K.) at a revolution of from 8,000 to 13,000 rpm. Thus, an emulsion (9) is prepared.

Solvent Removal

The emulsion (9) is fed into a container equipped with a stirrer and a thermometer, and the emulsion is heated for 8 hours at 30° C. to remove the organic solvent therefrom. Thus, a dispersion (9) is prepared.

Adherence of Particulate Resin

The dispersion (9) and the dispersion of the particulate vinyl copolymer resin (V-1) are mixed at a mixing ratio of 1/0.15 based on a solid content. The mixture is heated to 74° C. over a period of 30 minutes. A mixture liquid of 100 parts of ion-exchange water and 100 parts of magnesium chloride hexahydrate is gradually added thereto and kept for 3 hours at 74° C. Then the mixture is controlled to have a pH of 5 by adding an aqueous solution of hydrochloric acid. The mixture is heated to 80° C. for 2 hours, and then cooled down. Thus, a dispersion (9-2) is prepared.

The procedure for preparation of the toner (1) in Example 1 is repeated except the dispersion (1-2) is replaced with the dispersion (9-2). Thus, a toner (9) is prepared.

Comparative Example 4

The dispersion (2) prepared in Example 2 is washed and dried under the same condition as Example 1. Thus, a toner (10) is prepared.

The components of the toners prepared above are shown in Table 1. The properties of the polyester resins, particulate vinyl copolymer resins, and release agents used for preparation of the toners are shown in Tables 2, 3, and 4, respectively.

TABLE 1

| | Toner | Resin: Regions (B) and (C) (Core) | | Resin: Region (A) (Shell) | | | Release agent |
|---|---|---|---|---|---|---|---|
| | No. | Resin 1 | Resin 2 | Resin | Weight Ratio to core | Wax | Content(*) (parts) |
| Ex. 1 | 1 | P-1 | HP-1(**) | V-1 | 0.3 | A | 7.6 |
| Ex. 2 | 2 | P-1 | HP-1 | V-3 | 0.15 | B | 6.2 |
| Ex. 3 | 3 | P-2 | HP-1 | V-3 | 0.2 | A | 4.9 |
| Ex. 4 | 4 | P-2 | — | V-2 | 0.4 | A | 13.7 |
| Ex. 5 | 5 | P-1 | HP-1 | V-3 | 0.15 | B | 3.5 |
| Ex. 6 | 6 | P-2 | HP-1 | V-1 | 0.2 | C | 3.8 |
| Comp. Ex. 1 | 7 | P-3 | HP-1 | V-1 | 0.2 | E | 5.9 |
| Comp. Ex. 2 | 8 | P-1 | — | V-2 | 0.35 | D | 23.5 |
| Comp. Ex. 3 | 9 | P-3 | HP-1 | V-1 | 0.15 | A | 2.0 |
| Comp. Ex. 4 | 10 | P-1 | HP-1 | — | 0 | B | 6.0 |

Content(*): based on 100 parts of resin
HP-1(**): reactant of prepolymer and amine

TABLE 2

| Polyester resin | Mn | Mw | Tg (° C.) | Acid value |
|---|---|---|---|---|
| P-1 | 2,600 | 6,900 | 44 | 26 |
| P-2 | 2,800 | 7,200 | 44 | 33 |
| P-3 | 2,300 | 5,800 | 43 | 12 |

TABLE 3

| Particulate vinyl copolymer resin | Mn | Mw | Tg (° C.) | Particle diameter (nm) |
|---|---|---|---|---|
| V-1 | 11,000 | 19,000 | 63 | 51 |
| V-2 | 14,000 | 28,000 | 68 | 80 |
| V-3 | 12,000 | 23,000 | 68 | 88 |

TABLE 4

| | Wax | Endothermic peak (° C.) | Half bandwidth (° C.) |
|---|---|---|---|
| A | Paraffin wax | 74.2 | 5.2 |
| B | Polyethylene wax | 75.7 | 8.6 |

TABLE 4-continued

| | Wax | Endothermic peak (° C.) | Half bandwidth (° C.) |
|---|---|---|---|
| C | Ester wax | 83.1 | 4.2 |
| D | Carnauba wax | 75.4 | 6.0 |
| E | Montan wax | 82.5 | 11.2 |

Evaluation

The toners (1) to (10) are subjected to the following evaluations as a one-component developer. Of course, the toners can be used for a two-component developer.

Particle Diameter of Toner

The volume average particle diameter (Dv), number average particle diameter (Dp), and particle diameter distribution of a toner can be measured using an instrument COULTER COUNTER TA-II or COULETR MULTISIZER II from Coulter Electrons Inc.

The typical measuring method is as follows:

(1) 0.1 to 5 ml of a surfactant preferably alkylbenzene sulfonate) is included as a dispersant in 100 to 150 ml of an electrolyte (i.e., 1% NaCl aqueous solution including a first grade sodium chloride such as ISOTON-II from Coulter Electrons Inc.);

(2) 2 to 20 mg of a toner is added to the electrolyte and dispersed using an ultrasonic dispersing machine for about 1 to 3 minutes to prepare a toner suspension liquid;

(3) the volume and the number of toner particles are measured by the above instrument using an aperture of 100 μm to determine volume and number distribution thereof; and (4) the volume average particle diameter (Dv) and the weight average particle diameter (Dp) is determined.

In Examples of the present invention, the measuring method is as follows:

(1) 0.5 ml of a 10% alkylbenzene sulfonate aqueous solution is added as a dispersant to 100 ml of an electrolyte ISOTON-II (from Coulter Electrons Inc.);

(2) 10 mg of a toner is added in the electrolyte and dispersed using an ultrasonic dispersing machine for 3 minutes to prepare a toner suspension liquid;

(3) the volume and the number of toner particles are measured by the above instrument using an aperture of 100 μm to determine volume and number distribution thereof; and (4) the volume average particle diameter (Dv) and the weight average particle diameter (Dp) is determined.

The channels include 13 channels as follows: from 2.00 to less than 2.52 μm; from 2.52 to less than 3.17 μm; from 3.17 to less than 4.00 μm; from 4.00 to less than 5.04 μm; from 5.04 to less than 6.35 μm; from 6.35 to less than 8.00 μm; from 8.00 to less than 10.08 μm; from 10.08 to less than 12.70 μm; from 12.70 to less than 16.00 μm; from 16.00 to less than 20.20 μm; from 20.20 to less than 25.40 μm; from 25.40 to less than 32.00 μm; and from 32.00 to less than 40.30 μm. Namely, particles having a particle diameter of from not less than 2.00 μm to less than 40.30 μm can be measured.

Particle Diameter of Particulate Resin

The particle diameter of a particulate resin (such as a particulate vinyl copolymer resin) can be measured with particle size distribution analyzers such as LA-920 (from Horiba Ltd.) and UPA-EX T50 (from Nikkiso Co., Ltd.), by subjecting the dispersion of the particulate resin to the measurement.

In the present invention, the volume average particle diameter (Dv) of a sample is measured with UPA-EX150. The measurement method is as follows:

(1) a measurement cell is filled with a solvent to perform zero point adjustment;

(2) a dispersion of a particulate resin is added thereto so that the loading index is within a range of from 1 to 1.5; and (3) the volume average particle diameter (Dv) is measured.

As the solvent, pure water is used. The analysis conditions are as follows.

Refractive index of particle: 1.59
Transmittancy of particle: Transparence
Shape of particle: Spherical
Density of particle: 1
Refractive index of solvent: 1.333
Viscosity of solvent: 0.797 at 30° C., 1.002 at 20° C.
Filter: Standard
Sensitivity: Standard
Measurement time: 60 seconds
Zero Set: 30 seconds Average Circularity The shape of a particle is preferably determined by an optical detection method such that an image of the particle is optically detected by a CCD camera and analyzed. A particle suspension passes the image detector located on the flat plate so as to be detected.

The circularity of a particle is determined by the following equation:

$$\text{Circularity}=Cs/Cp$$

wherein Cp represents the length of the circumference of the image of a particle and Cs represents the length of the circumference of a circle having the same area as that of the image of the particle.

The average circularity of a toner can be determined using a flow-type particle image analyzer FPIA-2000 manufactured by Sysmex Corp. The typical measurement method is as follows:

(1) 0.1 to 0.5 ml of a surfactant (preferably alkylbenzene sulfonate) is included as a dispersant in 100 to 150 ml of water from which solid impurities have been removed;

(2) 0.1 to 0.5 g of a toner is added to the electrolyte and dispersed using an ultrasonic dispersing machine for about 1 to 3 minutes to prepare a toner suspension liquid including 3,000 to 10,000 per 1 micro-liter of the toner particles; and (3) the average circularity and circularity distribution of the toner are determined by the measuring instrument mentioned above.

In the Examples of the present invention, the measuring method is as follows:

(1) 0.5 ml of a 10% alkylbenzene sulfonate aqueous solution is included as a dispersant in 100 ml of water from which solid impurities have been removed;

(2) 0.3 g of a toner is added to the electrolyte and dispersed using an ultrasonic dispersing machine for 3 minutes to prepare a toner suspension liquid including 5,000 per 1 micro-liter of the toner particles; and (3) the average circularity and circularity distribution of the toner are determined by the measuring instrument mentioned above.

Wax Dispersing Condition

The wax dispersing condition is observed using a transmission electron microscope (TEM).

At first, toner particles are embedded in an epoxy resin, and then cut into an ultrathin section having a thickness of about 100 nm with a cryo-microtome, after the cross-section is stained with ruthenium tetroxide to distinguish a resin phase and a wax phase. The thus prepared ultrathin section is observed with a transmission electron microscope (TEM) at a magnification of 10,000 times to obtain toner section images. Among the toner section images, 20 randomly selected toner particles including a wax particle having a longest particle diameter of 0.9 to 1.2 times a volume average particle diameter of the toner particle are photographed to evaluate the wax dispersing condition.

In the images obtained from the stained ultrathin section, the surface portion of the wax particle is stained (i.e., having low contrast). On the other hand, the inner portion thereof is weakly or hardly stained (i.e., having high contrast) and a lamella phase is sometimes observed therein. This is because the surface of the toner is in an amorphous condition, while the inner portion thereof is in a crystalline condition.

An area ratio of the island portion formed of a wax is determined by averaging the data of the above 20 toner particles.

Endothermic Peak and Glass Transition Temperature

The endothermic peak and glass transition temperature of a toner are determined with a differential scanning calorimeter (DSC) such as DSC-6200 (from Seiko Instruments Inc.). The measurement method is as follows:

(1) 5 mg of a sample is measured and fed in an aluminum pan, and the aluminum pan containing the sample is set in a differential scanning calorimeter;

(2) the sample is heated from room temperature to 200° C., and then cooled to 0° C. at a temperature descending rate of 10° C./min; and (3) the sample is heated again at a temperature rising rate of 10° C./min to obtain an endothermic curve (i.e., a relationship between temperature and the amount of heat) of the sample.

The endothermic peak is defined as a peak observed in the endothermic curve in which an amount of heat is minimum.

The half bandwidth of the endothermic peak is determined as follows:

(1) a first line segment is vertically drawn from the top of the endothermic peak to the baseline of the endothermic curve;

(2) a second line is drawn in parallel with the baseline of the endothermic curve, while crossing the middle point of the first line segment; and (3) a temperature difference between two intersections of the second line and the endothermic curve is defined as the half bandwidth.

The glass transition temperature is determined by finding an intersection point of the endothermic curve and the line which is drawn between the middle of two baselines of the endothermic curve.

½ Method Temperature (T½)

A flow test is performed using a CAPILLARY RHEOMETER SHIMADZU FLOWMETER CFT-500 (from Shimadzu Corporation under the following conditions.

Sample amount: 1.5 g

Die: diameter 1.0 mm, height 1.0 mm

Temperature rising rate: 3.0° C./min

Preheating time: 180 sec

Load: 30 kg

Measurement temperature range: from 80 to 140° C.

A temperature at which a half of the sample is flowed out is defined as the ½ method temperature (T½).

Acid Value

In a conical flask, 1 to 1.5 g of a sample is dissolved in 20 ml of xylene while heating. Further, 20 ml of dioxane is added thereto, and the solution is titrated with a N/10 potassium hydroxide standard methanol solution using a 1% phenolphthalein solution as an indicator as soon as possible, before the solution becomes cloudy. The blank test is simultaneously performed. The acid value is calculated from the following formula:

$$AV=[5.61\times(A-B)\times f]/S$$

wherein AV represents the acid value, A (ml) represents the amount of the N/10 potassium hydroxide standard methanol solution used for the titration, B (ml) represents the amount of the N/10 potassium hydroxide standard methanol solution used for the blank test, f represents the factor of the N/10 potassium hydroxide standard methanol solution, and S (g) represents the amount of the sample.

Molecular Weight

The molecular weight of the resins such as polyester resins and vinyl copolymer resins are determined by GPC (Gel Permeation Chromatography) method under the following conditions:

Instrument used: HLC-8220GPC (from Tosoh Corporation)

Column: TSKgel SuperHZM-M×3

Temperature: 40° C.

Solvent: THF (tetrahydrofuran)

Flow rate: 0.35 ml/min

Sample: 0.01 ml of a sample having a resin content of from 0.05 to 0.6% by weight is injected The molecular weight of the resin is determined while comparing the molecular distribution curve thereof with the working curve which is previously prepared using 10 polystyrene standard samples each having a single molecular weight peak. Each of standard polystyrene has a molecular weight of from $5.8\times10^2$ to $7.5\times10^6$.

Thermostable Preservability

A toner is preserved for 8 hours at 50° C., and then sieved with a 42-mesh screen for 2 minutes. Thermostable preservability of the toner is evaluated by the residual ratio of toner particles remaining on the screen. The residual ratio is graded as follows:

Poor: not less than 30%

Average: not less than 20% and less than 30%

Good: not less than 10% and less than 20%

Very good: less than 10%

Transferability

At first, 130 g of a toner is set in a process cartridge for use in an image forming apparatus IPSIO CX2500 (from Ricoh Co., Ltd.). And then, 20 copies of a checkered printing pattern are produced under conditions of 23° C. and 45% RH. The twentieth produced checkered printing pattern is visually observed and evaluated as follows.

Very good: No problem in the produced image.

Good: White patches are slightly observed in line portions. No problem in practical use.

Average: White patches are clearly observed in line portions. Having problem in practical use.

Poor: Line portions are look like double lines. Having problem in practical use.

Charging Durability

A toner is set in a process cartridge for use in an image forming apparatus IPSIO CX2500 (from Ricoh Co., Ltd.). A running test in which a printing pattern having an image proportion of 3% is continuously produced is performed under conditions of 23° C. and 45% RH. After 50 copies and 1,500 copies are produced, toner particles existing on the developing roller are aspirated while copies having no image are produced, and then subjected to a measurement of charge quantity. The difference between the charge quantity after 50 copies and that after 1,500 copies are evaluated as follows.

Very good: The absolute value of the charge quantity difference is not greater than 5 μC/g.

Good: The absolute value of the charge quantity difference is 5 to 10 μC/g.

Average: The absolute value of the charge quantity difference is 10 to 15 μC/g.

Poor: The absolute value of the charge quantity difference is not less than 15 μC/g.

Fixing Separativeness

A toner treated with an external additive is set in an image forming apparatus IPSIO CX2500 (from Ricoh Co., Ltd.). Unfixed 36 mm-wide solid images (toner content: 10 g/m$^2$) are formed on the A4-size paper at a position of 3 mm behind the tip thereof while the A4-size paper is fed in the vertical direction. The unfixed images are fixed using a fixing device illustrated in FIG. 4 at a temperature of from 130° C. to 190° C. in 10° C. steps so that a toner-fixable temperature range can be determined. In the toner-fixable temperature range, separation of the paper from the heating roller is well performed, offset problem does not occur, and the image hardly peels off. The paper used for the evaluation has a basic weight of 45 g/m$^2$ and has a cross direction. The paper is fed in the vertical direction in which a paper having a cross direction has a disadvantage for the paper separation. The feeding speed of the fixing device is 120 mm/sec.

Figure 4:
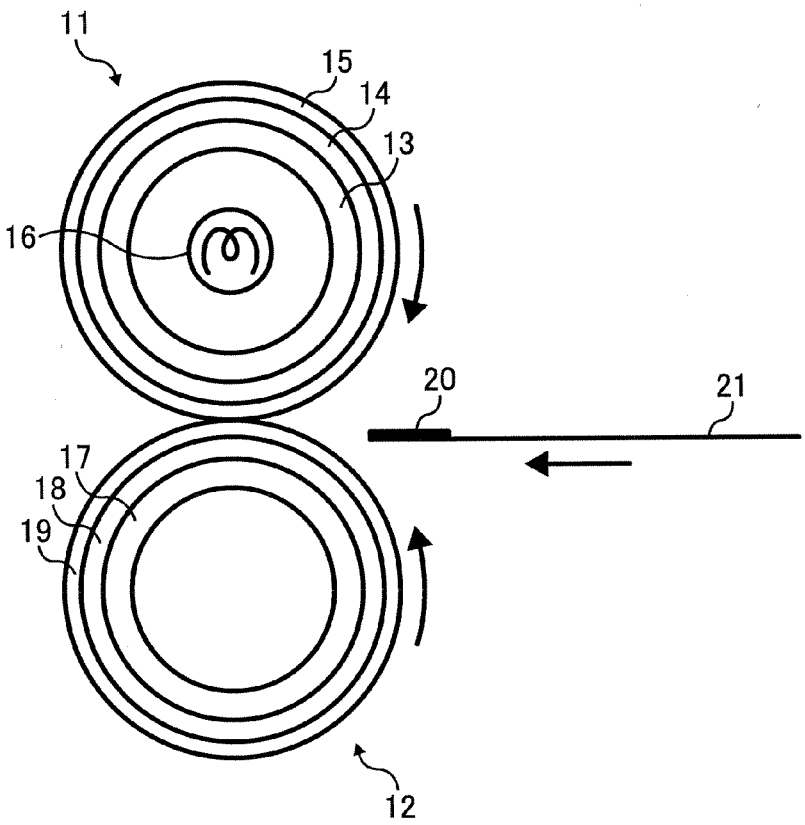
FIG. 4 is a schematic view illustrating an embodiment of a fixing device for fixing the toner of the present invention.

FIG. 4 is a schematic view illustrating the fixing device used for the evaluation of the toner of the present invention. The fixing device includes a soft roller having a fluorinated outermost layer. In particular, a heating roller 11 having an external diameter of 40 mm includes:

an aluminum cored bar 13;

an elastic layer 14 having a thickness of 1.5 mm and including a silicone rubber, which is located on the aluminum cored bar 13;

an outermost layer 15 including PFA (tetrafluoroethylene-perfluoro(alkylvinyl)ether copolymer), which is located on the elastic layer 14; and a heater 16 which is located inside the aluminum cored bar.

A pressing roller 12 having an external diameter of 40 mm includes:

an aluminum cored bar 17;

an elastic layer 18 having a thickness of 1.5 mm and including a silicone rubber, which is located on the aluminum cored bar 17; and an outermost layer 19 including PFA, which is located on the elastic layer 18.

A paper 21 having an unfixed image 20 thereon is fed in the direction indicated by an arrow.

The fixing separativeness is graded as follows:

Very good: A toner is fixable at all temperatures.

Good: The toner-fixable temperature range is not less than 50° C. and less than 70° C.

Average: The toner-fixable temperature range is not less than 30° C. and less than 50° C.

Poor: The toner-fixable temperature range is less than 30° C.

OHP Image Quality

A toner treated with an external additive is set in an image forming apparatus IPSIO CX2500 (from Ricoh Co., Ltd.). A printing pattern (No. 8 having an image proportion of 6%, issued by the Imaging Society of Japan) is produced on an overhead projection (OHP) sheet under conditions of 23° C. and 45% RH. The image is projected and visually observed to evaluate the exuding condition of the release agent.

Very good: The release agent does not exude out from the image.

Good: The release agent slightly exudes out to the edges of the characters. No problem in practical use.

Poor: The release agent exudes out to the edges of the characters. The characters are illegible.

The evaluation results are shown in Tables 5 and 6.

TABLE 5

| | | Particle diameter | | | | | DSC | | | | |
|---|---|---|---|---|---|---|---|---|---|---|---|
| | Toner | Dv | Dp | | Average | T½ | Endothermic peak | Half band-width | Wax distribution (%) | | |
| | No. | (μm) | (μm) | Dv/Dp | circularity | (° C.) | (° C.) | (° C.) | IA | IB | IC |
| Ex. 1 | 1 | 5.9 | 5.3 | 1.12 | 0.976 | 128 | 73.9 | 5.4 | 0 | 12.5 | 1.5 |
| Ex. 2 | 2 | 5.7 | 5.2 | 1.11 | 0.972 | 127 | 75.8 | 8.8 | 1.50 | 11.5 | 0 |
| Ex. 3 | 3 | 5.4 | 4.9 | 1.11 | 0.972 | 130 | 74.4 | 5.1 | 0 | 9.0 | 0 |
| Ex. 4 | 4 | 6.0 | 5.3 | 1.13 | 0.970 | 119 | 74.5 | 5.3 | 0 | 18.0 | 4.0 |
| Ex. 5 | 5 | 5.7 | 5.1 | 1.12 | 0.978 | 132 | 76.0 | 8.7 | 1.0 | 6.0 | 0 |
| Ex. 6 | 6 | 5.8 | 5.1 | 1.13 | 0.971 | 127 | 82.8 | 4.2 | 0 | 6.5 | 1.0 |
| Comp. Ex. 1 | 7 | 5.8 | 5.1 | 1.14 | 0.974 | 126 | 82.3 | 11.1 | 0 | 5.5 | 7.0 |
| Comp. Ex. 2 | 8 | 6.0 | 5.3 | 1.13 | 0.975 | 117 | 75.3 | 6.3 | 0 | 19.5 | 20.0 |
| Comp. Ex. 3 | 9 | 5.5 | 5.0 | 1.11 | 0.972 | 131 | 73.9 | 5.1 | 0.5 | 2.0 | 1.0 |
| Comp. Ex. 4 | 10 | 5.4 | 4.9 | 1.11 | 0.969 | 128 | 75.6 | 8.7 | 11.0 | 8.0 | 0 |

TABLE 6

| | Toner No. | Thermostable preserveability | Transferability | Charging durability | Fixing separativeness | OHP image quality |
|---|---|---|---|---|---|---|
| Ex. 1 | 1 | Very good | Very good | Very good | Very good | Very good |
| Ex. 2 | 2 | Good | Good | Good | Very good | Very good |
| Ex. 3 | 3 | Very good | Very good | Very good | Very good | Very good |
| Ex. 4 | 4 | Very good | Good | Very good | Good | Good |
| Ex. 5 | 5 | Good | Very good | Very good | Good | Very good |
| Ex. 6 | 6 | Very good | Very good | Very good | Good | Very good |
| Comp. Ex. 1 | 7 | Average | Very good | Average | Average | Very good |
| Comp. Ex. 2 | 8 | Average | Average | Average | Very good | Poor |
| Comp. Ex. 3 | 9 | Very good | Very good | Very good | Poor | Very good |
| Comp. Ex. 4 | 10 | Poor | Poor | Poor | Very good | Very good |

Preparation of Polyester

Preparation of Polyester (P-4)

The following components are fed in a reaction vessel equipped with a condenser, a stirrer and a nitrogen inlet pipe.

| | |
|---|---|
| Ethylene oxide (2 mole) adduct of bisphenol A | 553 parts |
| Propylene oxide (2 mole) adduct of bisphenol A | 196 parts |
| Terephthalic acid | 220 parts |
| Adipic acid | 45 parts |
| Dibutyltin oxide | 2 parts |

The mixture is reacted for 8 hours at 230° C. under normal pressure. Then the reaction is further continued for 5 hours under a reduced pressure of from 10 to 15 mmHg. Further, 26 parts of trimellitic anhydride is fed to the vessel to be reacted with the reaction product for 2 hours at 180° C. Thus, a polyester (P-4) is prepared.

The polyester (P-4) has a number average molecular weight (Mn) of 2,200, a weight average molecular weight (Mw) of 5,600, a glass transition temperature (Tg) of 43° C., and an acid value of 13 mgKOH/g.

Preparation of Particulate Vinyl Copolymer Resin

Preparation of Particulate Vinyl Copolymer Resin (V-4)

In a reaction vessel equipped with a condenser, a stirrer and a nitrogen inlet pipe, 1.6 parts of sodium dodecyl sulfate and 492 parts of ion-exchange water are contained and the mixture is heated to 80° C. Then a mixture of 2.5 parts of potassium persulfate (KPS) and 100 parts of ion-exchange water are added thereto. After 15-minutes left, a mixture of the following components is gradually added thereto over a period of 90 minutes.

| | |
|---|---|
| Styrene monomer | 152 parts |
| Butyl acrylate | 38 parts |
| Methacrylic acid | 10 parts |
| n-Octyl mercaptan (NOM) | 3.5 parts |

The mixture is kept for 60 minutes at 80° C., and then cooled down. Thus, an aqueous dispersion of a particulate vinyl copolymer resin (V-4) is prepared.

The particulate vinyl copolymer resin (V-4) has an average particle diameter of 51 nm. A part of the dispersion is contained in a petri dish so that a dispersion medium (i.e., water) is removed and a solid material (i.e., particulate vinyl copolymer resin) can be obtained. The particulate vinyl copolymer resin (V-4) has a number average molecular weight (Mn) of 11,000, a weight average molecular weight (Mw) of 18,000, and a glass transition temperature (Tg) of 65° C.

Preparation of Particulate Vinyl Copolymer Resins (V-5) to (V-10)

The procedure for preparation of the particulate vinyl copolymer resin (V-4) is repeated except for changing the components to those for particulate vinyl copolymer resins (V-5) to (v-10), respectively, described in Table 7.

TABLE 7

| Particulate vinyl copolymer resin | Monomers(parts) St | BA | MAA | M1 | M2 | NOM (parts) | KPS (parts) | Properties: Particle diameter (nm) | Mw ($\times 10^3$) | Tg (° C.) |
|---|---|---|---|---|---|---|---|---|---|---|
| V-4 | 152 | 38 | 10 | 0 | 0 | 3.5 | 2.5 | 50 | 18 | 65 |
| V-5 | 152 | 38 | 10 | 0 | 0 | 9.0 | 3.5 | 55 | 4.9 | 44 |
| V-6 | 152 | 38 | 10 | 0 | 0 | 2.8 | 2.5 | 50 | 24 | 68 |
| V-7 | 140 | 30 | 30 | 0 | 0 | 7.6 | 2.5 | 87 | 8.3 | 69 |
| V-8 | 152 | 38 | 10 | 0 | 0 | 4.1 | 2.5 | 57 | 14.3 | 58 |
| V-9 | 152 | 28 | 10 | 10 | 0 | 4.1 | 2.5 | 60 | 15 | 62 |
| V-10 | 152 | 18 | 10 | 10 | 10 | 4.1 | 2.5 | 70 | 13.2 | 55 |

The abbreviated names of the components are as follows.

St: Styrene

BA: Butyl acrylate

MAA: Methacrylic acid

M1: 2-Hydroxyethyl methacrylate

M2: 4-Carboxybutyl acrylate

NOM: n-Octyl mercaptan (Molecular weight controlling agent)

KPS: Potassium persulfate (Polymerization initiator)

Example 7

Preparation of Colorant/Wax Dispersion

In a reaction vessel equipped with a stirrer and a thermometer, 543.5 parts of the polyester (P-4), 150 parts of a paraffin wax (having a melting point of 68° C.), 225 parts of a wax dispersing agent (polyethylene graft WDA), and 1450 parts of an ethyl acetate are mixed and the mixture is heated to 80° C. while agitated. After being heated at 80° C. for 5 hours, the mixture is cooled to 30° C. over a period of 1 hour. Then 500 parts of the master batch (1) and 100 parts of ethyl acetate are added to the vessel, and the mixture is agitated for 1 hour to prepare a raw material mixture liquid (11).

Then 1500 parts of the raw material mixture liquid (11) are subjected to a dispersion treatment using a bead mill (ULTRAVISCOMILL (trademark) from Aimex Co., Ltd.). The dispersing conditions are as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Then 655 parts of a 65% ethyl acetate solution of the polyester (P-4) are added thereto. The mixture is subjected to a dispersion treatment using the bead mill. The dispersion conditions are the same as those mentioned above except that the dispersion operation is performed once (i.e., one pass).

Thus, a colorant/wax dispersion (11) is prepared. Some ethyl acetate is added to the colorant/wax dispersion (11) so that a solid content of the colorant/wax dispersion (11) is 50% at 130° C.

Preparation of Water Phase 968 parts of ion-exchange water, 40 parts of a 25% by weight of aqueous solution of a particulate resin (a copolymer of styrene-methacrylic acid-butyl acrylate-sodium salt of a sulfuric acid ester of ethylene oxide adduct of methacrylic acid) serving as a dispersion stabilizer, 150 parts of a 48.5% by weight of aqueous solution of a sodium salt of dodecyldiphenyl ether disulfonic acid (ELEMINOL MON-7 from Sanyo Chemical Industries Ltd.), and 98 parts of ethyl acetate are mixed. As a result, a milky liquid is prepared. Thus, a water phase (2) is prepared.

Emulsification

Then the following components are mixed in a vessel.

| | |
|---|---|
| Colorant/wax dispersion (11) | 976 parts |
| Isophorone diamine | 2.6 parts |

The components are mixed for 1 minute using a mixer TK HOMOMIXER (from Tokushu Kika Kogyo K.K.) at a revolution of 5,000 rpm. Then 88 parts of the prepolymer (1) is added thereto and mixed for 1 minute using a mixer TK HOMOMIXER (from Tokushu Kika Kogyo K.K.) at a revolution of 5,000 rpm.

Then 1200 parts of the water phase (2) is added thereto. The mixture is agitated for 20 minutes with a mixer TK HOMOMIXER (from Tokushu Kika Kogyo K.K.) at a revolution of from 8,000 to 13,000 rpm. Thus, an emulsion (11) is prepared.

Solvent Removal

The emulsion (11) is fed into a container equipped with a stirrer and a thermometer, and the emulsion is heated for 8 hours at 30° C. to remove the organic solvent therefrom. Thus, a dispersion (11) is prepared.

Adherence of Particulate Resin

The dispersion (11) and the dispersion of the particulate vinyl copolymer resin (V-4) are mixed at a mixing ratio of 1/0.15 based on a solid content. The mixture is heated to 73° C. over a period of 30 minutes. A mixture liquid of 100 parts of ion-exchange water and 100 parts of magnesium chloride hexahydrate is gradually added thereto and kept for 4 hours at 73° C. Then the mixture is controlled to have a pH of 5 by adding an aqueous solution of hydrochloric acid. The mixture is heated to 80° C. for 2 hours, and then cooled down. Thus, a dispersion (11-2) is prepared.

The procedure for preparation of the toner (1) in Example 1 is repeated except the dispersion (1-2) is replaced with the dispersion (11-2). Thus, a toner (11) is prepared.

Examples 8 to 10 and Comparative Examples 5 to 8

The procedure for preparation of the toner (11) in Example 7 is repeated except for changing the amounts of the wax dispersing agent (WDA) and the wax, and the primary particle diameter to those for toners (12) to (18), respectively, described in Table 8.

TABLE 8

| | Toner No. | WDA (% based on wax) | Primary particle diameter (μm) | Wax (% based on toner) |
|---|---|---|---|---|
| Ex. 7 | 11 | 150 | 0.6 | 6 |
| Ex. 8 | 12 | 600 | 0.6 | 3 |
| Ex. 9 | 13 | 20 | 0.4 | 5 |
| Ex. 10 | 14 | 40 | 0.4 | 4 |
| Comp. Ex. 5 | 15 | 200 | 0.6 | 6 |
| Comp. Ex. 6 | 16 | 15 | 0.6 | 6 |
| Comp. Ex. 7 | 17 | 180 | 1.0 | 6 |
| Comp. Ex. 8 | 18 | 15 | 1.0 | 5 |

Evaluations

The toners (11) to (18) are subjected to the following evaluations.

Particle Diameter of Toner

The volume average particle diameter (Dv), number average particle diameter (Dp), and particle diameter distribution of a toner can be measured using an instrument COULTER COUNTER TA-II or COULETR MULTISIZER II from Coulter Electrons Inc.

The measuring method is as follows:

(1) 0.1 to 5 ml of a surfactant (preferably alkylbenzene sulfonate) is included as a dispersant in 100 to 150 ml of an electrolyte (i.e., 1% NaCl aqueous solution including a first grade sodium chloride such as ISOTON-II from Coulter Electrons Inc.);

(2) 2 to 20 mg of a toner is added to the electrolyte and dispersed using an ultrasonic dispersing machine for about 1 to 3 minutes to prepare a toner suspension liquid;

(3) the volume and the number of toner particles are measured by the above instrument using an aperture of 100 μm to determine volume and number distribution thereof; and (4) the volume average particle diameter (Dv) and the weight average particle diameter (Dp) is determined.

The channels include 13 channels as follows: from 2.00 to less than 2.52 μm; from 2.52 to less than 3.17 μm; from 3.17 to less than 4.00 μm; from 4.00 to less than 5.04 μm; from 5.04 to less than 6.35 μm; from 6.35 to less than 8.00 μm; from 8.00 to less than 10.08 μm; from 10.08 to less than 12.70 μm; from 12.70 to less than 16.00 μm; from 16.00 to less than 20.20 μm; from 20.20 to less than 25.40 μm; from 25.40 to less than 32.00 μm; and from 32.00 to less than 40.30 μm. Namely, particles having a particle diameter of from not less than 2.00 μm to less than 40.30 μm can be measured.

Particle Diameter of Wax

A toner is immersed in a solvent (such as chloroform) in which the binder resin of the toner can be dissolved while the wax included in the toner cannot be dissolved (such as chloroform). The solvent is then subjected to a centrifugal separation so that the wax particles are suspended. The wax particles are collected and photographed by a scanning electron microscope (SEM), and then the photographs are analyzed with an image analyzer LUZEX 5000 (from Nireco Corporation) to determine the particle diameter distribution of the wax particles.

Fixing Separativeness (as Two-Component Developer)

At first, 7 parts of a toner treated with an external additive are mixed with 93 parts of a carrier used for an image forming apparatus IPSIO COLOR 8000 (from Ricoh Co., Ltd.), to prepare a developer.

The developer is set in IPSIO COLOR 8000 (from Ricoh Co., Ltd.). Unfixed 36 mm-wide solid images (toner content: 9 g/m$^2$) are formed on the A4-size paper at a position of 3 mm behind the tip thereof while the A4-size paper is fed in the vertical direction. The unfixed images are fixed using a fixing device illustrated in FIG. 4 at a temperature of from 130° C. to 190° C. in 10° C. steps so that a toner-fixable temperature range can be determined. In the toner-fixable temperature range, separation of the paper from the heating roller is well performed, offset problem does not occur, and the image hardly peels off. The paper used for the evaluation has a basic weight of 45 g/m$^2$ and has a cross direction. The paper is fed in the vertical direction in which a paper having a cross direction has a disadvantage for the paper separation. The feeding speed of the fixing device is 120 mm/sec.

The fixing separativeness is graded as follows:

Good: The toner-fixable temperature range is not less than 50° C.

Average: The toner-fixable temperature range is not less than 30° C. and less than 50° C.

Poor: The toner-fixable temperature range is less than 30° C.

Toner Filming (as Two-Component Developer)

At first, 7 parts of a toner treated with an external additive are mixed with 93 parts of a carrier used for an image forming apparatus IPSIO COLOR 8000 (from Ricoh Co., Ltd.), to prepare a developer.

The developer is set in IPSIO COLOR 8000 (from Ricoh Co., Ltd.). A first running test in which 1,000 copies of a character image pattern having an image area proportion of 12% are continuously produced is performed. After the first running test, a part of the developer is ejected. Further, a second running test in which 10,000 copies of the above pattern are continuously produced is performed. The photoreceptor and the intermediate transfer belt are visually observed before the first running test, after the first running test, and after the second running test, to determine whether the toner film was formed thereon. The evaluation is performed as follows.

Good: No toner film is observed on both the photoreceptor and the intermediate transfer belt.

Average: Toner film is observed on either the photoreceptor or the intermediate transfer belt, but not observed in the produced image. No problem in practical use.

Poor: The toner film is observed on either or both of the photoreceptor and the intermediate transfer belt, and also observed in the image produced. Having problem in practical use.

Fixing Separativeness (as One-Component Developer)

A toner treated with an external additive (i.e., one-component developer) is set in IPSIO CX2500 (from Ricoh Co., Ltd.). Unfixed 36 mm-wide solid images (toner content: 9 g/m$^2$) are formed on the A4-size paper at a position of 3 mm behind the tip thereof while the A4-size paper is fed in the vertical direction. The unfixed images are fixed using a fixing device illustrated in FIG. 4 at a temperature of from 130° C. to 190° C. in 10° C. steps so that a toner-fixable temperature range can be determined. In the toner-fixable temperature range, separation of the paper from the heating roller is well performed, offset problem does not occur, and the image hardly peels off. The paper used for the evaluation has a basic weight of 45 g/m$^2$ and has a cross direction. The paper is fed in the vertical direction in which a paper having a cross direction has a disadvantage for the paper separation. The feeding speed of the fixing device is 120 mm/sec.

The fixing separativeness is graded as follows:

Good: The toner-fixable temperature range is not less than 50° C.

Average: The toner-fixable temperature range is not less than 30° C. and less than 50° C.

Poor: The toner-fixable temperature range is less than 30° C.

Toner Filming (as One-Component Developer)

A toner treated with an external additive is set in IPSIO CX2500 (from Ricoh Co., Ltd.). A running test in which 2,000 copies of a printing pattern having an image area proportion of 6% are continuously produced is performed at 23° C. and 45% RH. After the running test, the photoreceptor and the intermediate transfer belt are visually observed to determine whether the toner film was formed thereon. The evaluation is performed as follows:

Good: No toner film is observed on both the photoreceptor and the intermediate transfer belt.

Average: Toner film is observed on either the photoreceptor or the intermediate transfer belt, but not observed in the produced image. No problem in practical use.

Poor: The toner film is observed on either or both of the photoreceptor and the intermediate transfer belt, and also observed in the image produced. Having problem in practical use.

Stress Resistance (Toner Adhesion to Blade)

A toner treated with an external additive is set in IPSIO CX2500 (from Ricoh Co., Ltd.). A running test in which a printing pattern having an image area proportion of 6% are continuously produced is performed at 23° C. and 45% RH. After 50 copies and 2,000 copies are produced, a solid image is produced. The controlling blade is taken out of the developing device and toner particles present thereon are blown off, and then visually observed whether the toner adheres to the controlling blade. The toner adhesion is graded as follows.

Good: The toner does not adhere to the blade.

Average: The toner slightly adheres to the blade, but no problem in the resultant image.

Poor: The resultant image has an image noise due to occurrence of the toner adhesion to the blade.

The evaluation results are shown in Table 9.

TABLE 9

| | Toner | | Wax | | Evaluations (as two-component developer) | | Evaluations (as one-component developer) | | |
|---|---|---|---|---|---|---|---|---|---|
| | Toner No. | Dp (μm) | Dw (μm) | Peak particle diameter (μm) | Fixing separativeness | Toner filming | Fixing separativeness | Blade adhesion | Toner filming |
| Ex. 7 | 11 | 6.2 | 2.5 | 2.7 | Good | Good | Good | Good | Good |
| Ex. 8 | 12 | 6.0 | 2.2 | 2.4 | Good | Good | Good | Good | Good |
| Ex. 9 | 13 | 6.1 | 3.8 | 2.1/4.2 | Good | Good | Good | Good | Good |
| Ex. 10 | 14 | 6.2 | 3.0 | 1.7/3.8 | Good | Good | Good | Good | Good |
| Comp. Ex. 5 | 15 | 6.3 | 1.3 | 1.5 | Poor | Good | Poor | Good | Good |
| Comp. Ex. 6 | 16 | 6.2 | 4.2 | 4.6 | Good | Poor | Good | Poor | Poor |
| Comp. Ex. 7 | 17 | 6.2 | 1.8 | 1.0/3.8 | Poor | Good | Poor | Average | Good |
| Comp. Ex. 8 | 18 | 6.3 | 4.4 | 2.2/5.2 | Good | Average | Good | Poor | Average |

This document claims priority and contains subject matter related to Japanese Patent Applications Nos. 2006-009404 and 2006-025871, filed on Jan. 18, 2006 and Feb. 2, 2006, respectively, the entire contents of each of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner, comprising:

a binder resin;

a colorant; and a release agent in an amount of from 3 to 15 parts by weight based on 100 parts by weight of the binder resin, wherein the toner has a volume average particle diameter (Dv) of from 3 to 9 μm, and wherein the binder resin and the release agent form a sea-island structure in which the island formed of the release agent is dispersed in the sea formed of the binder resin in a cross-sectional image of the toner obtained by a transmission electron microscope (TEM), and the following relationships are satisfied:

$$IB>IA \text{ and } IB>IC$$

wherein IA represents an area ratio (%) of the island in an outermost region (A) of the cross-sectional image of the toner, having a thickness of 0.05 Dv; IB represents an area ratio (%) of the island in an intermediate region (B) thereof located under the outermost region (A), having a thickness of 0.15 Dv; and IC represents an area ratio (%) of the island in an innermost region (C) thereof located under the intermediate region (B), and wherein in a cross section of the toner, the domain of the release agent has an average longest particle diameter of from 0.1 to 2.5 μm.

2. The toner according to claim 1, wherein the following relationships are further satisfied:

$$0 \leqq IA \leqq 5,\ 3 \leqq IB \leqq 70,\ 0 \leqq IC \leqq 5, \text{ and } IC>IA.$$

3. The toner according to claim 1, wherein the toner has an average circularity of from 0.930 to 0.995.

4. The toner according to claim 1, wherein the toner has at least one endothermic peak in a temperature range of from 60 to 90° C., when measured by a differential scanning calorimeter (DSC).

5. The toner according to claim 4, wherein the endothermic peak has a half bandwidth not larger than 8° C.

6. The toner according to claim 1, wherein the release agent is a hydrocarbon wax.

7. The toner according to claim 1, wherein the toner has a ½ method temperature (T½) of from 110 to 140° C., when measured by a flow tester.

8. The toner according to claim 1, wherein each of the intermediate region (B) and the innermost region (C) comprises a binder resin (R1), and the outermost region (A) comprises a binder resin (R2), wherein the binder resin (R1) comprises a resin (R11) having a polyester skeleton, and the binder resin (R2) comprises a vinyl copolymer resin (V), and wherein a weight ratio (i.e., (A)/((B)+(C))) of the outermost region (A) to the sum of the intermediate region (B) and the innermost region (C) is from 0.05 to 0.5.

9. The toner according to claim 8, wherein the binder resin (R2) is formed by subjecting particles of the vinyl copolymer resin (V) to at least one of aggregation and fusion.

10. The toner according to claim 8, wherein the binder resin (R2) has a weight average molecular weight not larger than 50,000 and a glass transition temperature of from 40 to 80° C.

11. The toner according to claim 8, wherein the binder resin (R1) comprises a modified polyester resin (R12) having at least one of a urethane and a urea bond.

12. The toner according to claim 11, wherein the modified polyester resin (R12) comprises a modified polyester resin (R14) formed by subjecting a modified polyester resin (R13) having an isocyanate group at its end and an amine to at least one of an elongation reaction and a cross-linking reaction.

13. The toner according to claim 1, wherein the following relationship is further satisfied:

$$(1/3)Dp \leqq Dw \leqq (2/3)Dp$$

wherein Dp (μm) represents a number average particle diameter of the toner and Dw (μm) represents an average particle diameter of the release agent.

14. The toner according to claim 13, wherein the release agent has a particle diameter distribution property such that at least two peaks are present.

15. A method of preparing a toner, comprising:

dissolving or dispersing core constituents comprising a resin having a polyester skeleton or precursor thereof, a colorant, a release agent in an organic solvent to prepare a core constituent mixture liquid;

dispersing the core constituent mixture liquid in an aqueous medium to prepare a first dispersion comprising core particles in which the release agent is locally present at the surfaces or near the surfaces thereof;

adding a second dispersion comprising a particulate vinyl copolymer resin (V) to the first dispersion to adhere the particulate vinyl copolymer resin (V) to the core particles, wherein the aqueous medium comprises a particulate resin (P) as a dispersion stabilizer.

16. The method of preparing a toner according to claim 15, further comprising:

removing the organic solvent from the first dispersion before adding the second dispersion to the first dispersion.

17. The method of preparing a toner according to claim 15, further comprising:

adding a metal salt having 1 to 3 valences to the first dispersion when the second dispersion is added thereto.

18. The method of preparing a toner according to claim 15, further comprising:

heating the mixture to a temperature of not less than a glass transition temperature of the particulate vinyl copolymer resin after adding the second dispersion to the first dispersion.

19. The method of preparing a toner according to claim 15, further comprising:

heating the mixture to a temperature at which the particulate vinyl copolymer resin is fused on the core particles after adding the second dispersion to the first dispersion.

20. The method of preparing a toner according to claim 15, wherein the core constituent mixture liquid further comprises a modified polyester resin (R13) having an isocyanate group at its end and an amine capable of reacting with the modified polyester resin (R13).

21. The toner according to claim 1, wherein the following relationships are further satisfied:

$$0 \leqq IA \leqq 2,\ 5 \leqq IB \leqq 50,\ 0 \leqq IC \leqq 2, \text{ and } IC > IA.$$

22. The toner according to claim 1, wherein the following relationships are further satisfied:

$$IA = 0,\ 5 \leqq IB \leqq 50,\ IC = 0.$$

* * * * *